US006609791B1

(12) United States Patent
Miyamoto et al.

(10) Patent No.: US 6,609,791 B1
(45) Date of Patent: Aug. 26, 2003

(54) INK JET TYPE IMAGE FORMING DEVICE

(75) Inventors: Kazutaka Miyamoto, Tokyo (JP); Naruhiko Itou, Tokyo (JP); Ryoma Suzuki, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 09/936,467

(22) PCT Filed: Mar. 21, 2000

(86) PCT No.: PCT/JP00/01700

§ 371 (c)(1),
(2), (4) Date: Dec. 20, 2001

(87) PCT Pub. No.: WO00/54975

PCT Pub. Date: Sep. 21, 2000

(30) Foreign Application Priority Data

Jun. 17, 1999 (JP) ..... 11-170465
Jun. 23, 1999 (JP) ..... 11-176827
Dec. 7, 1999 (JP) ..... 11-347696

(51) Int. Cl.[7] ..... B41J 13/00
(52) U.S. Cl. ..... 347/104
(58) Field of Search ..... 347/104, 1, 22

(56) References Cited

U.S. PATENT DOCUMENTS 5,831,655 A 11/1998 Asawa et al.
5,854,648 A 12/1998 Hanabusa

FOREIGN PATENT DOCUMENTS

| | | |
|---|---|---|
| EP | 395003 | 10/1990 |
| JP | 57-4787 | 1/1982 |
| JP | 59-160259 | * 10/1984 |
| JP | 62-161574 | 7/1987 |
| JP | 2-283469 | 11/1990 |
| JP | 4-90354 | 3/1992 |
| JP | 4-63255 | * 5/1992 |
| JP | 4-122037 | * 10/1992 |
| JP | 6-24062 | 2/1994 |
| JP | 07-40146 | * 7/1995 |
| JP | 8-174943 | 7/1996 |
| JP | 8-258355 | 10/1996 |
| JP | 9-234916 | 9/1997 |

* cited by examiner

*Primary Examiner*—Huan Tran
(74) *Attorney, Agent, or Firm*—Dellett and Walters

(57) ABSTRACT

Between adjacent pinch rollers 22, an auxiliary roller 44 is provided coaxially with the pinch rollers 22. A large diameter portion 44*a* of the auxiliary roller 44 presses down a recording medium on a platen 12. Between the auxiliary roller 44 and an image formation zone 41, there is provided a downstream sheet-pressing member 46. The large diameter portion 46*a* of the downstream sheet-pressing member 46 also presses down the recording medium against the platen 12.

37 Claims, 35 Drawing Sheets

(a)

(b)

(c)

INK JET TYPE IMAGE FORMING DEVICE

TECHNICAL FIELD

The present invention relates to an ink-jet type image-forming apparatus which forms images by ejecting ink onto a recording medium.

BACKGROUND TECHNIQUE

Ink-jet image-forming apparatuses for printing by ejecting ink onto a recording medium like a recording paper sheet are known as a kind of output apparatus of computers and work stations. A conventional ink-jet type image-forming apparatus is explained by reference to FIG. 33.

FIG. 33 is a perspective view showing an example of conventional ink-jet type image-forming apparatuses.

A plotter 10 has a platen 12 which supports a recording paper sheet (not shown in the drawing) delivered in the direction indicated by the arrow A (delivery direction). Above the platen 12, two guide rails 14*a*, 14*b* are provided parallel to the platen 12. A carriage 16 is attached through a slider bearing (not shown in the drawing) to the two guide rails 14*a*, 14*b* to be slidable in reciprocation (in the scanning direction perpendicular to the recording sheet delivery direction). The guide rail 14*a* is fixed to a casing 15.

A printing head 18 is mounted on the carriage 16. Plural ink ejection outlets (not shown in the drawing) are formed on the ink ejection face (not shown in the drawing) of the printing head 16. Five ink cartridges 18K, 18K (black), 18C (cyan), 18M (magenta), and 18Y (yellow) are provided demountably on the printing head 18.

With the printing head placed above the platen 12, the ink ejection face of the printing head 18 fronts the image formation zone. The inks are ejected through the ink ejection outlets at a prescribed timing to form a band portion of an image. Then the recording sheet is delivered by one printing band breadth by pinch rollers 22 held by holding arms 20 and delivery rollers 24. Again with reciprocating movement of the carriage 16 in the arrow B direction (main scanning direction), the inks are ejected through the ink ejection outlets in accordance with image signals to form image on the new portion of the image formation area of the recording sheet. This operation is repeated to form the entire image on the recording sheet. The printed portion of the recording sheet is guided outside by a sheet discharge guide 26.

In the formation of an image on the recording sheet, the amount of the inks ejected onto the unit area of the recording sheet varies depending on the kind of the image. For example, in formation of a drawing, the amount of the ink per unit area is less since straight lines and curved lines are printed mainly. On the other hand, there are cases where a larger amount of ink is used per unit area. Such cases of a larger amount of the ink application is explained below by reference to FIGS. 34–36.

FIG. 34 is a perspective view illustrating the waving of the recording sheet. FIG. 35 is a schematic drawing illustrating a rising state of the recording sheet in positional relation with the printing head. FIG. 36 is a perspective view illustrating the occurrence of the waviness at the edge portion in the breath direction of the recording sheet. In these drawings, the same symbols are used for corresponding constitutional elements as in FIG. 33.

When a large amount of the ink is ejected per unit area of the recording sheet 30, waviness 32 of the recording sheet 30 occurs as shown in FIG. 34. The waviness 32 forms crest portions 30*a* and trough potions 30*b* in the recording sheet 30. The crest portion 30*a* rises from the platen 12. On the other hand, the distance between the platen 12 and the printing head 18 is designed to be smaller for improving the image quality (print quality). Therefore, the crest portion 30*a* of the recording sheet 30 can be higher than the level of the ink ejection face (head face) 18*a* of the printing head. In such a case, the crest portion 30*a* may rub the ink ejection face 18*a*, whereby the crest portion 30*a* may be smeared or damaged.

The waviness 32 arises usually at the printed portions 34 of the recording sheet 30 onto which ink has been ejected (ink has been absorbed). However, the waviness 32 sometimes spreads upstream against the recording sheet delivery direction. The waviness 32 may further spread upstream beyond the pinch rollers 22.

When the waviness 32 has occurred upstream beyond the image formation zone, the ink ejection at this wavy portion 32 further enlarges the waviness 32 to increase the rise of the crest portion 30*a*. This augments the liability of smearing and damaging of the crest portion by rubbing with the ink ejection face 18*a*. The enlargement of the waviness may cause rise of the breadth end portion 30*c*. This may cause hooking of this end portion 30*c* by the printing head 18 to tear the recording sheet.

One method for solving this problem is to decrease the amount of one ejection of the ink to a practically acceptable minimum amount. However, this decrease of the amount of the ink ejection may decrease the rate of image formation on the recording sheet 30 (printing speed), or may lower the image density (printing density).

As described above, in formation of an image on the recording paper sheet, ink is ejected onto the recording sheet from the printing head 18 on the carriage 16 reciprocating in the arrow B direction. A portion of the ink ejected from the printing head 18 may be scattered around in a mist state before the ejected ink reaches (deposits on) the recording paper sheet. The scattered ink (mist of ink) can stain the image formation area of the recording sheet. To prevent the staining of the image formation area and periphery thereof by the mist, a sheeting member (not shown in the drawing) is provided slightly upstream in the recording sheet delivery direction. This sheeting member is long and narrow, extending in the arrow B direction, and the recording sheet is delivered through under this sheeting member.

However, the mist can adhere to the sheeting member, and can smudge the hand and clothes of the operator when the operator touches the sheeting member.

DISCLOSURE OF THE INVENTION

The present invention intends to provide an ink-jet type image formation apparatus which does not cause a trouble owing to an ink ejected from a printing head.

A first embodiment of the ink-jet type image-forming apparatus of the present invention for achieving the above object is an image-forming apparatus for forming an image in a portion of an image formation area of a recording medium delivered in a prescribed delivery direction, provided with a recording medium delivery unit, the unit comprising:

(1) a driving roller provided upstream before the image formation zone in the recording medium delivery direction for delivering the recording medium, (2) a driven roller for holding and delivering the recording medium jointly with the driving roller, and (3) a rise-suppressing member provided upstream before the image formation zone in the recording medium delivery direction for suppressing rise of the recording medium.

The rise-suppressing member may comprise (4) an upstream sheet-pressing member provided rollably and nearly coaxially with the driven roller, and (5) a recording sheet-controlling member provided between the upstream sheet-pressing member and the image formation zone, and extending perpendicular to the recording medium delivery direction.

The recording medium delivery unit may comprise (6) a touch-controlling means for controlling attach or detach of the driven roller to or from the driving roller, and (7) the rise-suppressing member may be moved jointly with the touch-controlling means.

(8) The sheet-controlling member may have been treated for water repellence at the portion fronting the image formation zone.

A second embodiment of the ink-jet type image-forming apparatus of the present invention for achieving the above object is provided with a carriage carrying a printing head for ejecting ink, and movable in reciprocation in the prescribed main scanning direction for forming an image on a portion of a recording medium delivered in a prescribed delivery direction in an image formation zone by ejecting an ink from the printing head, the ink-jet type image-forming apparatus comprising:

(9) a rise-suppressing member provided upstream before the image formation zone in the recording medium delivery direction for suppressing rise of the recording medium, and

(10) a cleaning member for cleaning the rise-suppressing member.

The aforementioned ink-jet type image-forming apparatus may comprise:

(11) a driving roller which is placed upstream before the image formation zone in the sheet delivery direction and delivers the recording medium in the delivery direction,

(12) a driven roller which is driven by the driving roller and delivers the recording sheet by catching the recording sheet jointly with the driving roller, and

(13) the rise-suppressing member is placed between the driving roller and the image formation zone, and may have a bar-shaped sheet-controlling member extending in an auxiliary scanning direction nearly perpendicular to the aforementioned scanning direction.

(14) The sheet-controlling member may be made of an electric insulating material.

(15) The sheet-controlling means may be electrically chargeable in a polarity opposite to the polarity of the ink ejected from the printing head.

(16) The cleaning member may be made of an electroconductive material and may be grounded.

(17) The cleaning member may be fixed to the printing head or the carriage.

(18) The cleaning member may be rollable freely in contact with the rise-suppressing member.

A third embodiment of the ink-jet type image-forming apparatus of the present invention for achieving the above object is provided with a carriage carrying a printing head for ejecting ink and being movable in reciprocation in the prescribed main scanning direction for forming an image on a portion of a recording medium delivered in a prescribed delivery direction in an image formation zone by ejecting an ink from the printing head, the ink-jet type image-forming apparatus comprising:

(19) a rise-suppressing member for suppressing a rise of the recording medium around the image formation zone, and

(20) a static eliminating member fixed to the printing head or the carriage to discharge firstly the electric charge accumulated in the rise-suppressing member.

A fourth embodiment of the ink-jet type image-forming apparatus of the present invention for achieving the above object is characterized by a cleaning member for cleaning a sheeting member sheeting an area on and around the upstream side beyond the image formation zone in the recording sheet delivery direction in the ink-jet recording apparatus for forming an image by ejecting an ink from a printing head mounted on a carriage reciprocating in a prescribed main scanning direction to form an image on a portion of a recording medium delivered in a prescribed delivery direction and placed in the image formation zone in front of the printing head,

(21) the cleaning member for cleaning the aforementioned sheeting member being fixed at least one of the carriage and the printing head.

(22) The printing head may be demountable from the carriage, and

(23) the cleaning member may be fixed to the printing head.

(24) The cleaning member may have a cleaning roller rollable with the movement of the cleaning member in the main scanning direction.

A fifth embodiment of the ink-jet type image-forming apparatus of the present invention comprises a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen in an image formation zone,

(25) the image forming apparatus being characterized by a pressing means provided near the image formation zone to press the delivered recording medium against the platen.

(26) The image formation zone is provided downstream after the delivery means in the delivery direction, and

(27) the pressing means may press down, against the platen, the recording medium at the portion ranging from the upstream side before the delivery means to the image formation zone throughout the entire breadth perpendicular to the delivery direction.

(28) The pressing means may be incorporated into the delivery means, and may press or not press the recording medium against the plotter depending on the state of delivery or non-delivery of the recording medium.

(29) The pressing means may be made of a flexible sheet material.

(30) The pressing means may comprise a bar-shaped member placed between the image formation zone and the recording medium delivery means.

(31) The delivery means may pull back the recording medium so as to be sheeted by the pressing means at the downstream end of the recording medium in the delivery direction in a standby state before starting the image formation.

(32) The delivery means may move , in removal of the recording medium at a standby position, the recording medium forward by a prescribed length in the delivery direction to bring the downstream end of the recording medium to be on a downstream side of the pressing means in the delivery direction.

(33) The ink-jet type image forming means may be provided with (33-1) an openable protecting member for covering the image formation zone and the pressing means, and (33-2) an opening-closing detection means to emit opening-closing detection signals by detecting the opening-closing state of the protection member, and

(34) the delivery means may deliver the recording medium in accordance with the opening-closing signals from the aforementioned opening-closing detection means.

BRIEF DESCRIPTION OF THE DRAWINGS

FIG. 6(*b*) is a perspective view illustrating a holding member. FIG. 6(*c*) is a perspective view of a pinch roller arm.

FIG. 8(*b*) is a schematic view of the pinch roller detached from the delivery roller.

BEST MODE FOR CARRYING OUT THE INVENTION

The embodiments of the present invention will be explained by reference to drawings.

A first embodiment of the ink-jet type image-forming apparatus of the present invention will be explained by reference to FIGS. 1–7.

Figure 1:
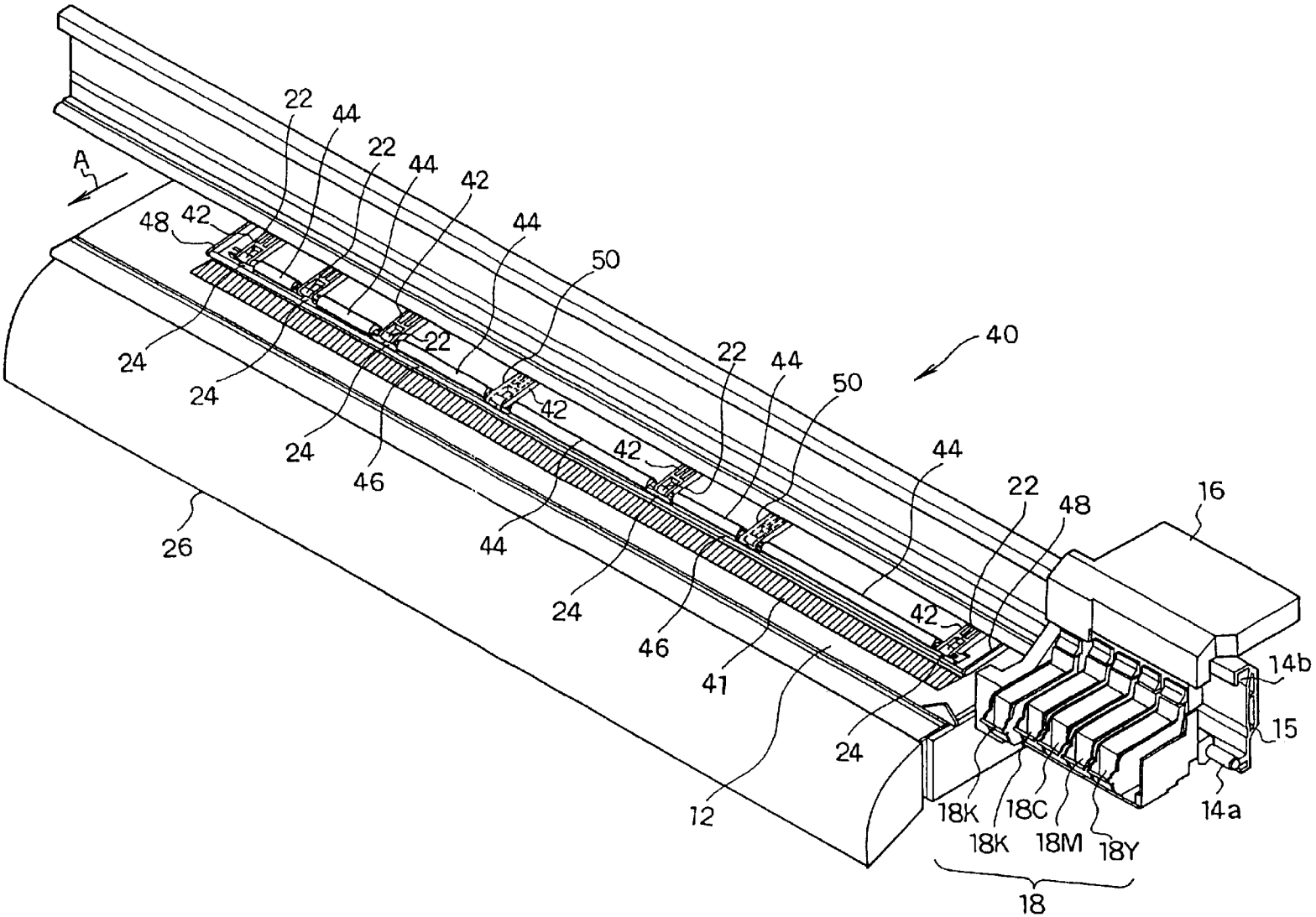
FIG. 1 is a perspective view illustrating a plotter incorporated into a recording medium delivery unit.
Figure 2:
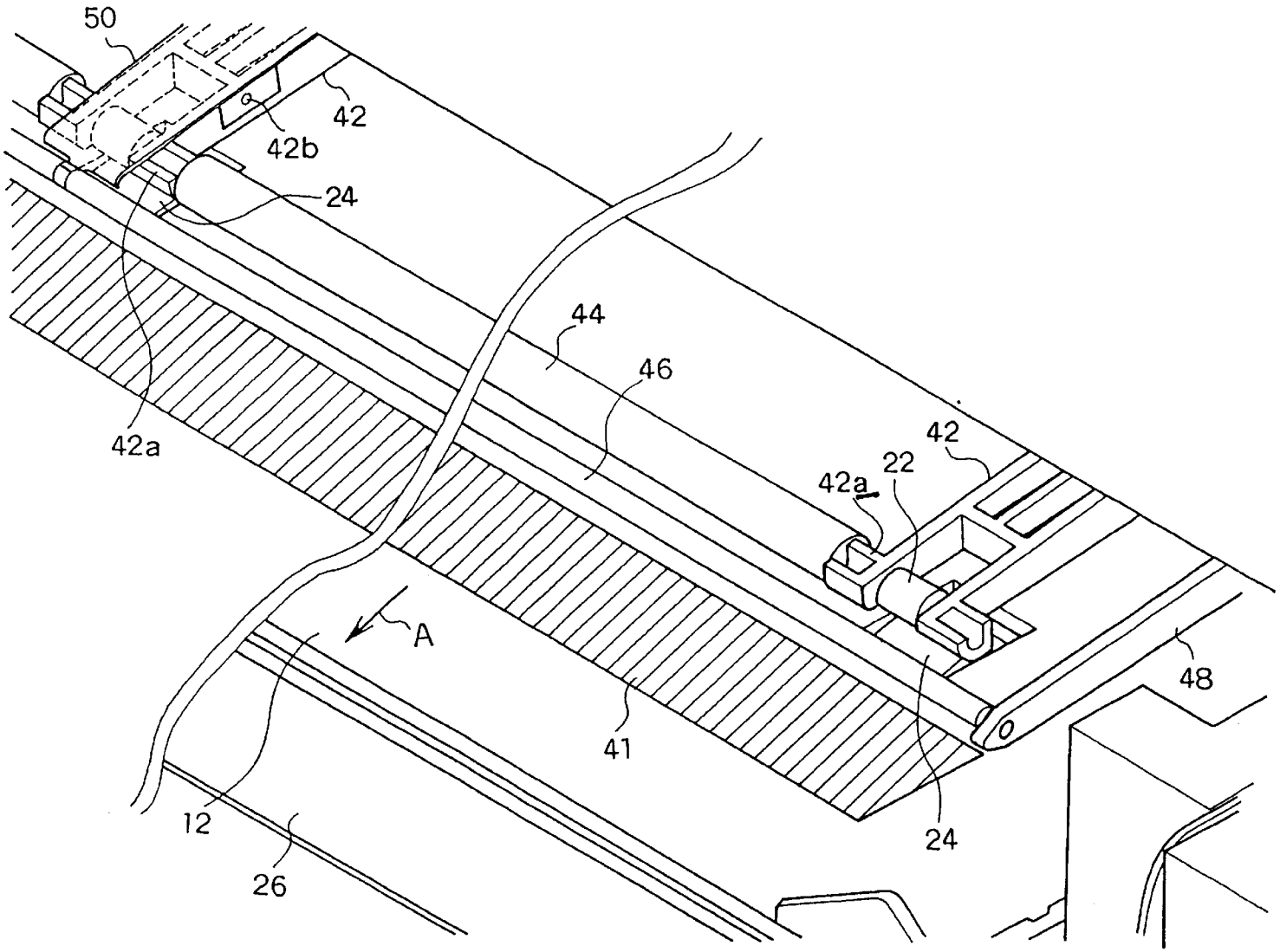
FIG. 2 is an enlarged perspective view illustrating an upstream sheet-pressing member.
Figure 3:
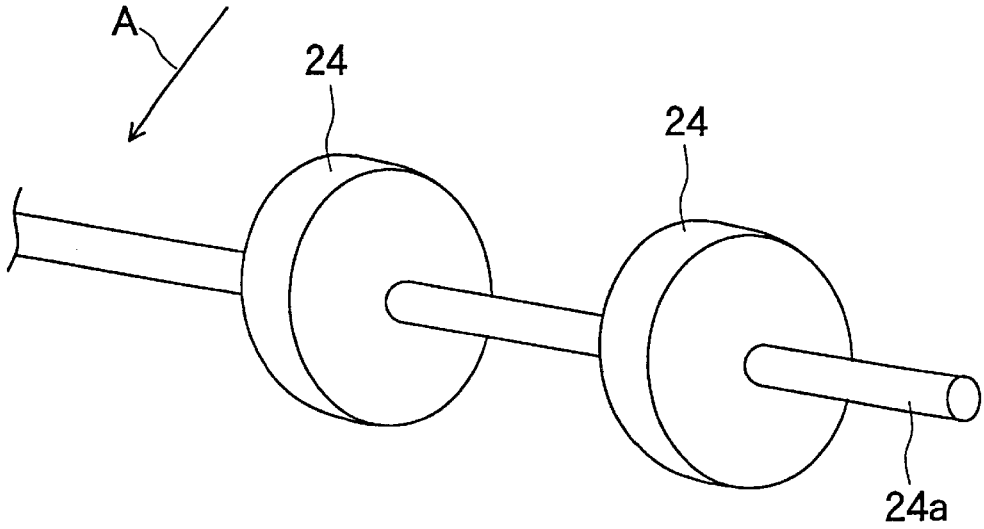
FIG. 3 is a perspective view illustrating a part of a delivery roller.
Figure 4:
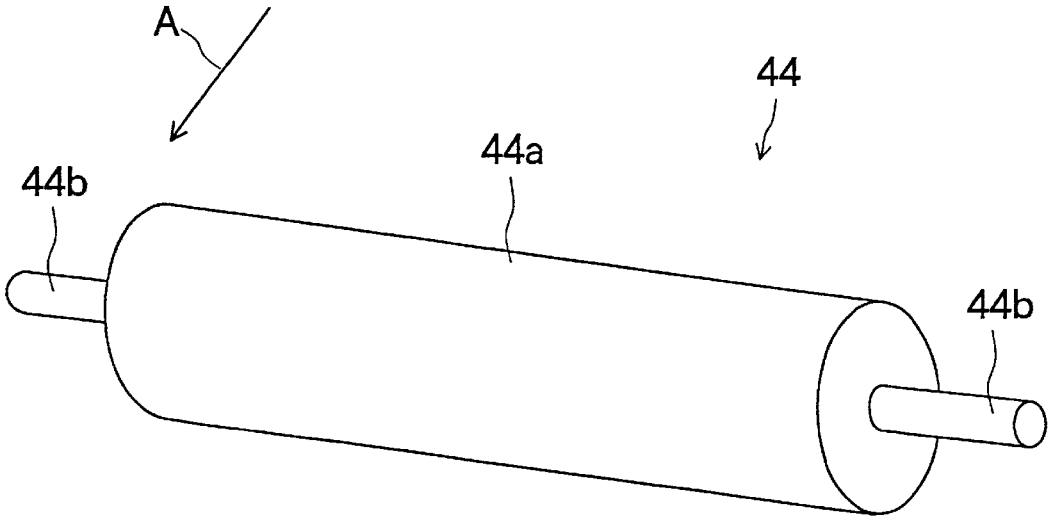
FIG. 4 is a perspective view illustrating an upstream sheet-pressing member.
Figure 5:
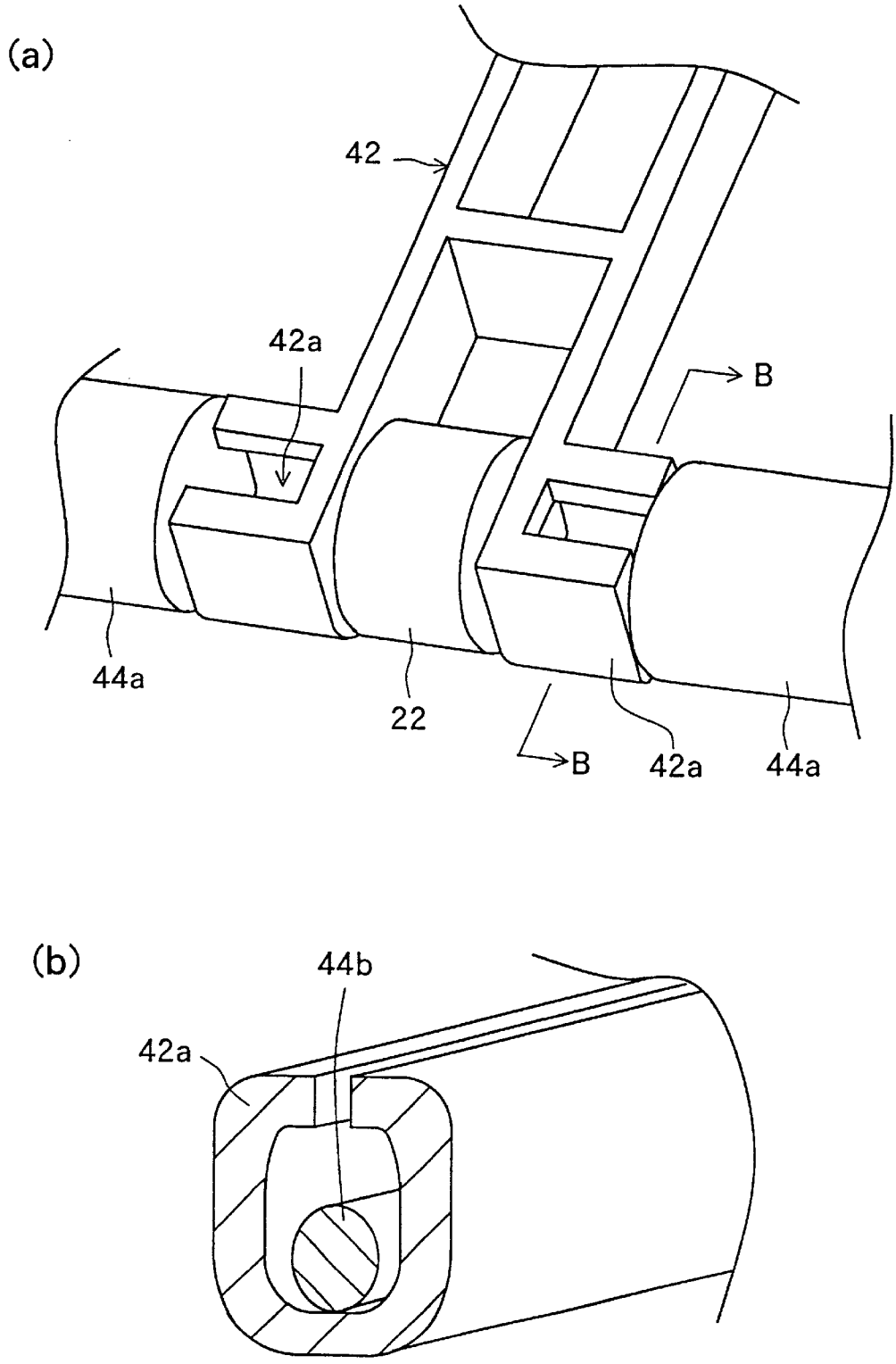
FIG. 5(*a*) is a perspective view of a pinch roller arm having an upstream sheet-pressing member attached thereto, and FIG. 5(*b*) is a sectional view at line B—B in FIG. 5(*a*).
Figure 6:
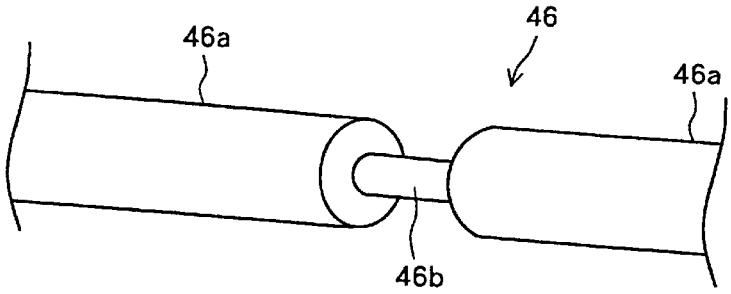
FIG. 6(*a*) is a perspective view illustrating a downstream sheet-pressing member.
Figure 6:
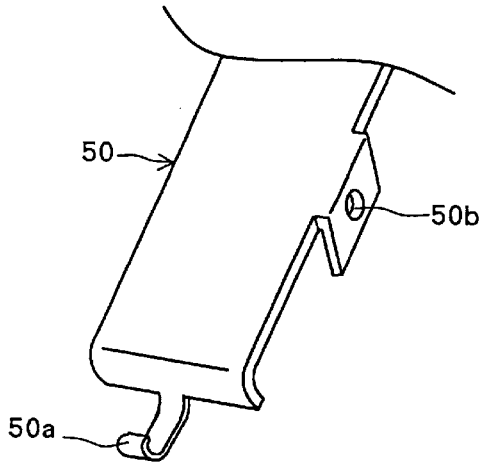
Figure 6:
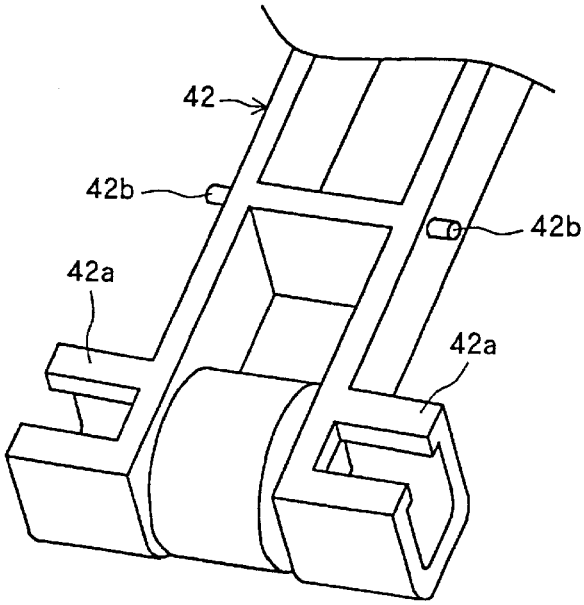
Figure 7:
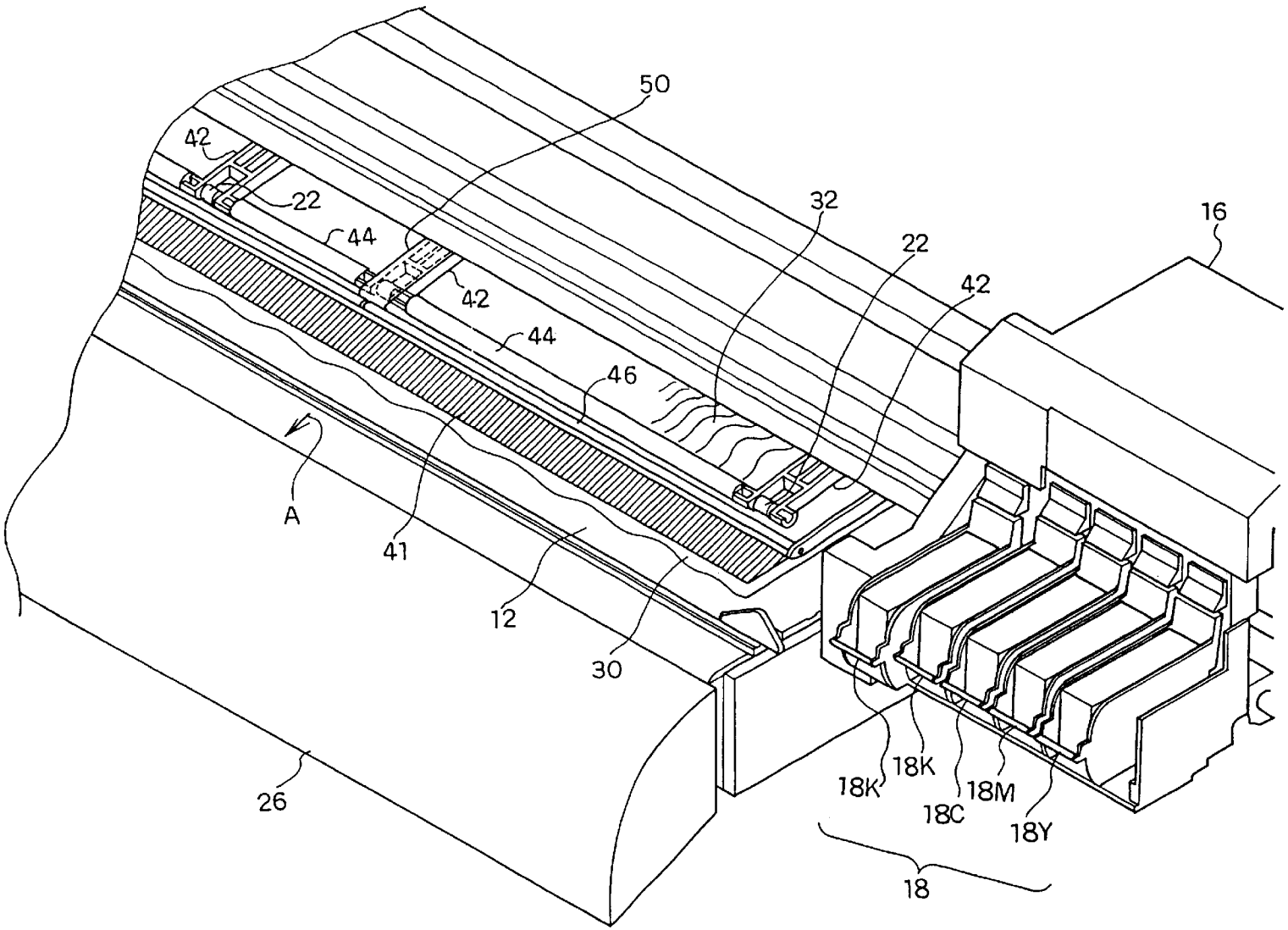
FIG. 7 is a schematic view of the state of suppressing the waviness of a recording medium.

FIG. 1 is a perspective view illustrating a plotter incorporated into a recording medium delivery unit. FIG. 2 is an enlarged perspective view illustrating an upstream sheet-pressing member. FIG. 3 is a perspective view illustrating a part of a delivery roller. FIG. 4 is a perspective view illustrating an upstream sheet-pressing member. FIG. 5(*a*) is a perspective view of a pinch roller arm having an upstream sheet-pressing member attached thereto, and FIG. 5(*b*) is a sectional view at line B—B in FIG. 5(*a*). FIG. 6(*a*) is a perspective view illustrating a downstream sheet-pressing member. FIG. 6(*b*) is a perspective view illustrating a holding member. FIG. 6(*c*) is a perspective view of a pinch roller arm. FIG. 7 is a schematic view of the state of suppressing the waviness of a recording medium. In these drawings, the same symbols are used to represent the corresponding constitutional elements as in FIGS. 33–36. In a plotter 40, the recording medium is held between delivery rollers 24 (an example of the driving roller of the present invention) and pinch rollers 22 (an example of the driven roller of the present invention), and is delivered toward a sheet discharge guide 26. An image is formed by ejecting an ink to a recording medium at the region (image formation zone 41) situated between a printing head 18 and a platen 12. A touch-controlling member 60 (an example of the touch-controlling means of the present invention, see FIG. 8) is provided to attach or detach the pinch roller 22 to or from the delivery roller 24. This touch-controlling member 60 will be explained later.

The plural delivery rollers 24 are fixed, as shown in FIG. 3, at certain distances to a rolling axis 24*a* extending in the main scanning direction perpendicular to the recording medium delivery direction (arrow A direction), and are placed upstream before the image formation zone 41 in the recording medium delivery direction. The rolling axis 24*a* is connected to a delivery motor (not shown in the drawing) to rotate the delivery rollers 24 by rotation of the delivery motor.

Above the delivery rollers 24, a pinch roller 22 is placed respectively. Each of the pinch rollers 22 is fixed rollably to the tip portion of the respective pinch roller arms 42 placed at prescribed intervals. Between the adjacent pinch rollers 22, an auxiliary roller 44 (an example of the upstream sheet-pressing member of the present invention) is provided coaxially with the pinch rollers 22. This auxiliary roller 44 has a larger-diameter portion 44*a* and a smaller-diameter axis portion 44*b*. The larger-diameter portion 44*a* presses down the portion of the recording medium on the platen 12. Thereby, the rise of this portion of the recording medium caused by the ejected ink is prevented by this larger-diameter portion 44*a*. The smaller-diameter axis portion 44*b* fits to a bearing portion 42*a* of the pinch roller arm 42 as shown in FIG. 5(*a*).

The bearing portion 42*a* of the pinch roller arm 42 is in a shape of a hole having a vertically long cross-section (longer in the direction of attaching to the platen 12 as shown in FIG. 5(*b*). Therefore, the axis 44*b* of the auxiliary roller 44 is movable vertically inside the bearing portion 42*a*, which enables the auxiliary roller 44 to move vertically. Therefore, the delivered recording sheet can be pressed down readily to suppress the rising regardless of the thickness of the recording sheet.

The image formation zone 41 is placed downstream after the auxiliary roller 44. A downstream sheet-pressing member 46 (an example of the sheet-controlling member of the present invention) between the auxiliary roller 44 and the image formation zone 41. The downstream sheet-pressing member 46 is in a shape of a cylinder extending in the main scanning direction, having a length larger than the breadth of the largest size of the recording medium applicable to the plotter 40. The auxiliary roller 44 and the downstream sheet-pressing member 46 constitute a rise-suppressing member of the present invention.

The downstream sheet-pressing member 46 has a larger-diameter portion 46*a* and a smaller-diameter portion 46*b* as shown in FIG. 6(*a*). The larger-diameter portion 46*a* presses the recording sheet down on the portion of the recording sheet placed on the platen 12. Therefore, the rise of this portion of the recording medium caused by the ejected ink is prevented by this larger-diameter portion 46*a*. Both of the length ends of the downstream sheet-pressing member 46 are held rollably by an arm member 48 extending in the arrow-A direction as shown in FIG. 2. The portion of the downstream sheet-pressing member 46 fronting the image formation zone 41 (or fronting the platen 12) is treated for water repellence, whereby the confronting portion is less liable to be soiled by the ink, and less liable to stain the delivered recording medium.

The smaller-diameter portion (axis portion) 46*b* of the downstream sheet-pressing member 46 is fit into a bearing portion 50*a* of a holding member 50 as shown in FIG. 6(*b*). The holding member 50 is fixed to hang over a pinch roller arm 42. For this fixation, projections 42*b* formed in the pinch roller arm 42 are fit into holes 50*b* formed in the holding member 50.

During image formation by ink ejection on a recording paper sheet 30, waviness 32 may occur upstream before the image formation zone 41 in the recording medium delivery direction. Of the waviness 32, the portion caused upstream before the auxiliary roller 44 in the recording sheet delivery direction (upstream waviness) can be suppressed by the auxiliary roller 44 during passage of the recording medium under the auxiliary roller 44. Thereby, the rise of the recording sheet by the upstream waviness can be suppressed , and the recording sheet with the waviness nearly canceled is delivered in a nearly flat state downstream beyond the auxiliary roller 44 in the recording medium delivery direction.

On the other hand, the waviness caused between the auxiliary roller 44 and the downstream sheet-pressing member 46 (downstream waviness) is suppressed by the downstream sheet-pressing member 46 during passage of the recording medium under the downstream sheet-pressing member 46. Thereby, the rise of the recording medium by the downstream waviness is suppressed, and the recording medium is delivered to the downstream side after the downstream sheet-pressing member 46 with the upstream waviness nearly canceled. Consequently, the recording medium is delivered in a nearly flat state to the image formation zone 41 without causing contact with the printing head 18 or hooking thereby.

The touch-controlling member is explained by reference to FIG. 8.

Figure 8:
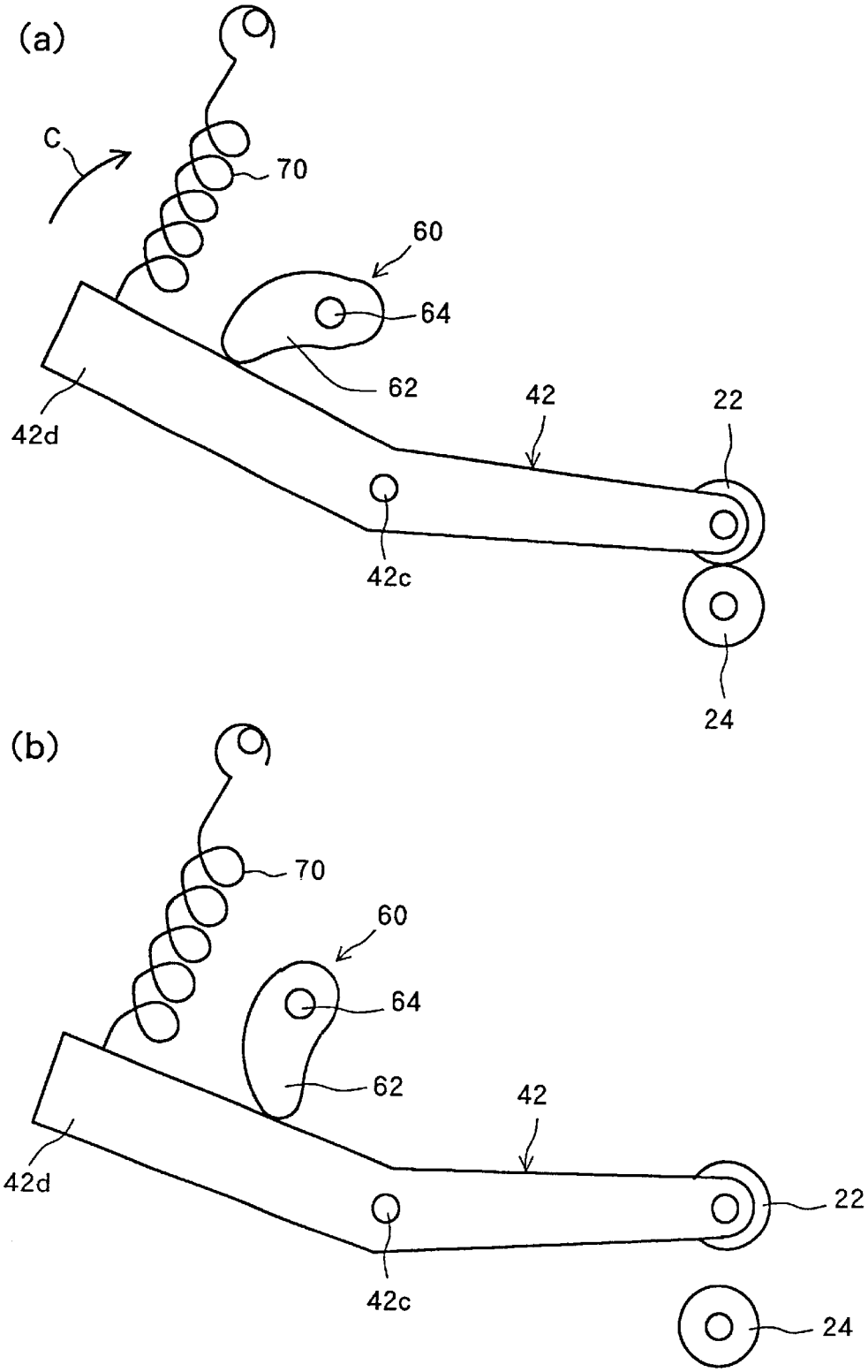
FIG. 8(*a*) is a schematic view of a pinch roller pressing a delivery roller.

FIG. 8(*a*) is a schematic view of a pinch roller pressing a delivery roller. FIG. 8(*b*) is a schematic view of the pinch roller detached from the delivery roller.

The pinch roller arm 42 is constituted to be turnable around a turning axis 42*c* provided at the center of the length thereof. A coil spring 70 is fixed at its one end to the back end 42*d* of the pinch roller arm 42. Thereby, the pinch roller arm 42 is energized so as to turn to move the back end 42*d* to the arrow C direction. A touch-controlling member 60 is placed slightly above the middle portion between the turning axis 42*c* and the back end 42*d* of the pinch roller arm 42 for attaching or detaching the pinch roller 22 to or from the delivery roller 24.

The touch-controlling member 60 has a cam 62 and a turning axis 64 for fixing the cam 62. An operating lever (not shown in the drawing) is fixed to the length end of the turning axis 64.

Therefore, the auxiliary roller 44 (see FIG. 1) and the downstream sheet-pressing member 46 are moved in connection with the touch-controlling member 60 by operation of the operating lever to move the touch-control lever. When the touch-controlling member 60 is moved to allow the pinch roller 22 to press the delivery roller 24 (so that the pinch roller 22 comes into contact with the delivery roller 24 as shown in FIG. 8(*a*)), the auxiliary roller 44 and the downstream sheet-pressing member 46 move to suppress the rise of the recording medium. On the other hand, when the touch-controlling member 60 is moved so as to allow the pinch roller 22 to be apart from the delivery roller 24, the auxiliary roller 44 and the downstream sheet-pressing member 46 moves not to suppress the rise of the recording medium.

A second embodiment of the ink-jet type image-forming apparatus of the present invention is explained by reference to FIGS. 9–13.

Figure 9:
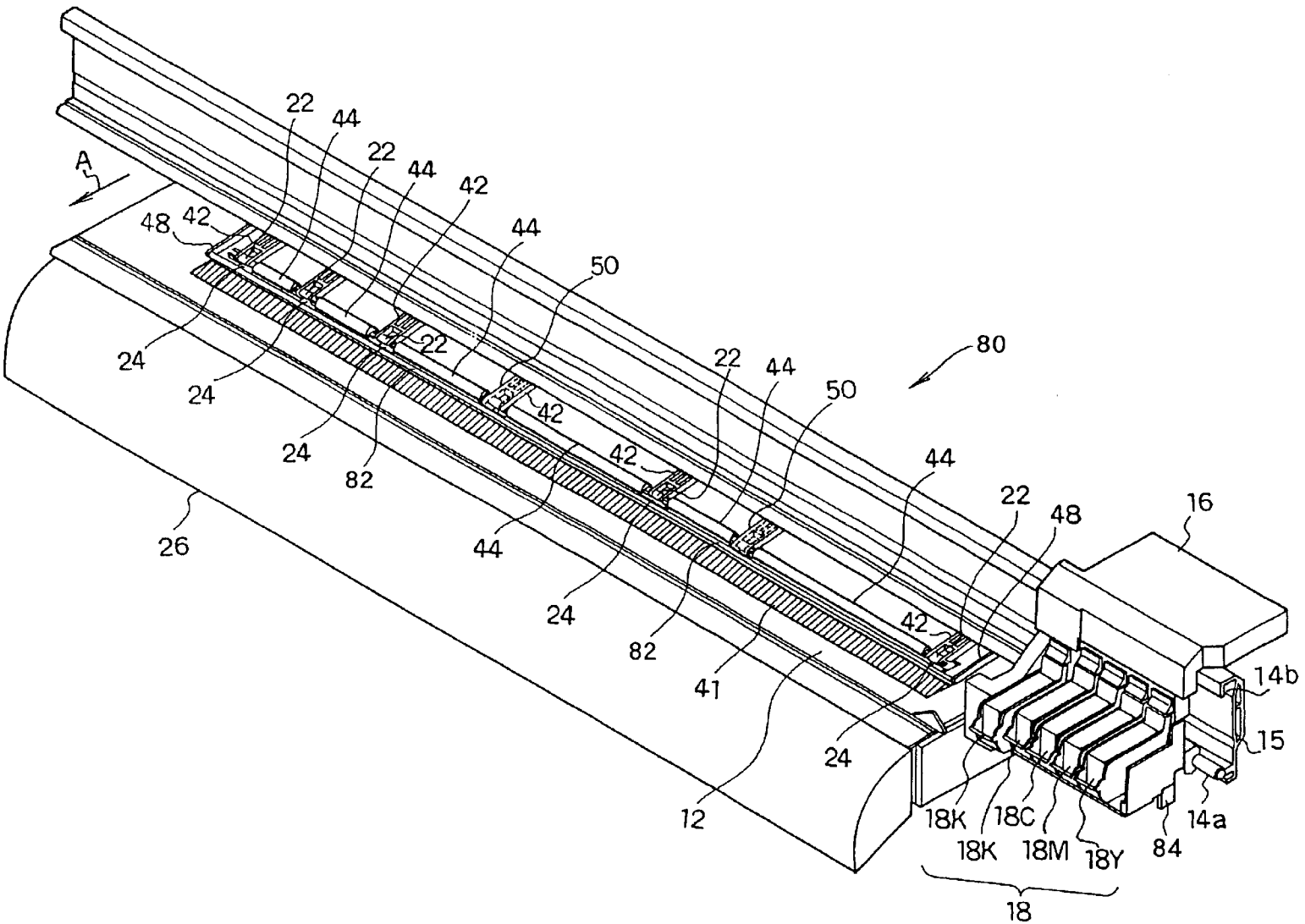
FIG. 9 is a perspective view illustrating a plotter, an example of the ink-jet type image-forming apparatus of the present invention.
Figure 10:
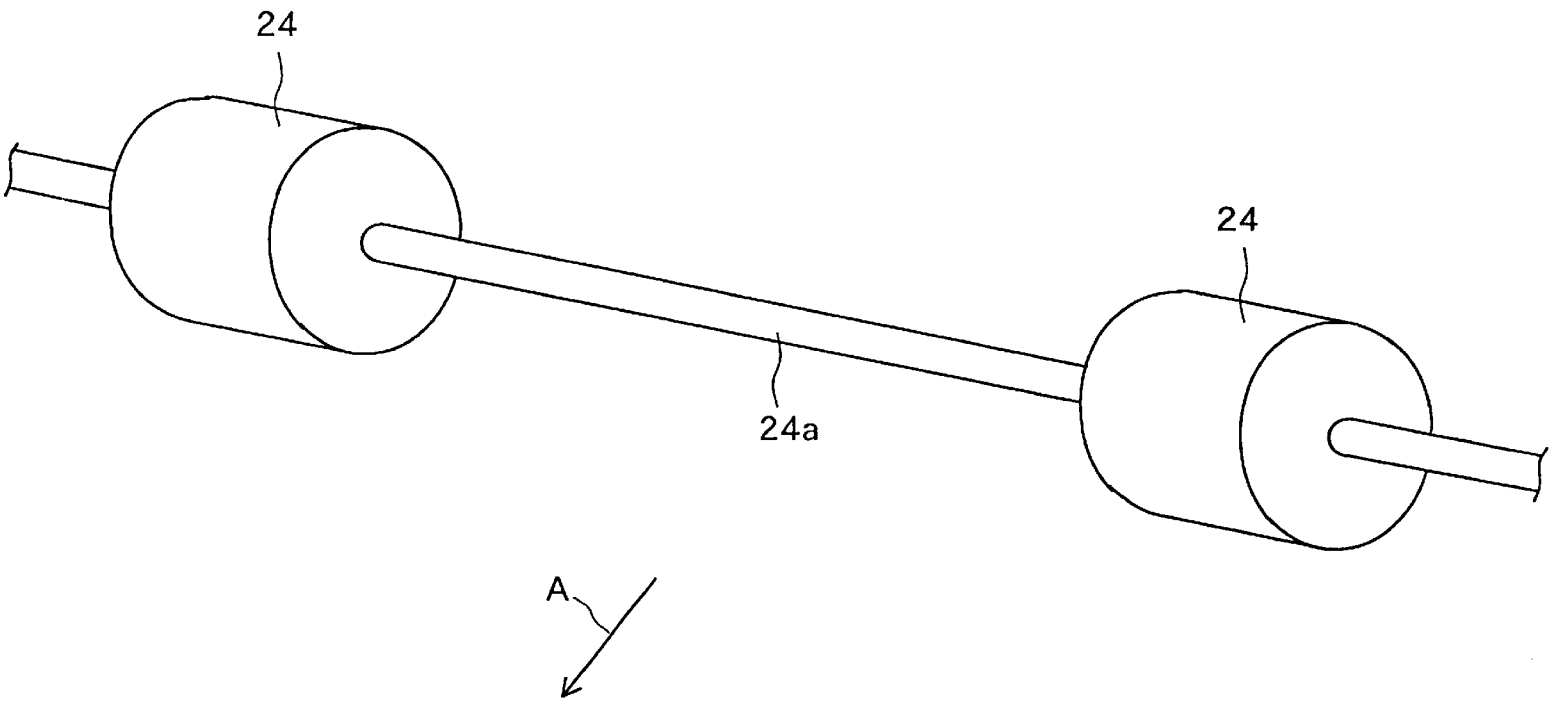
FIG. 10 is a perspective view of a part of the delivery roller of the plotter shown in FIG. 9.
Figure 11:
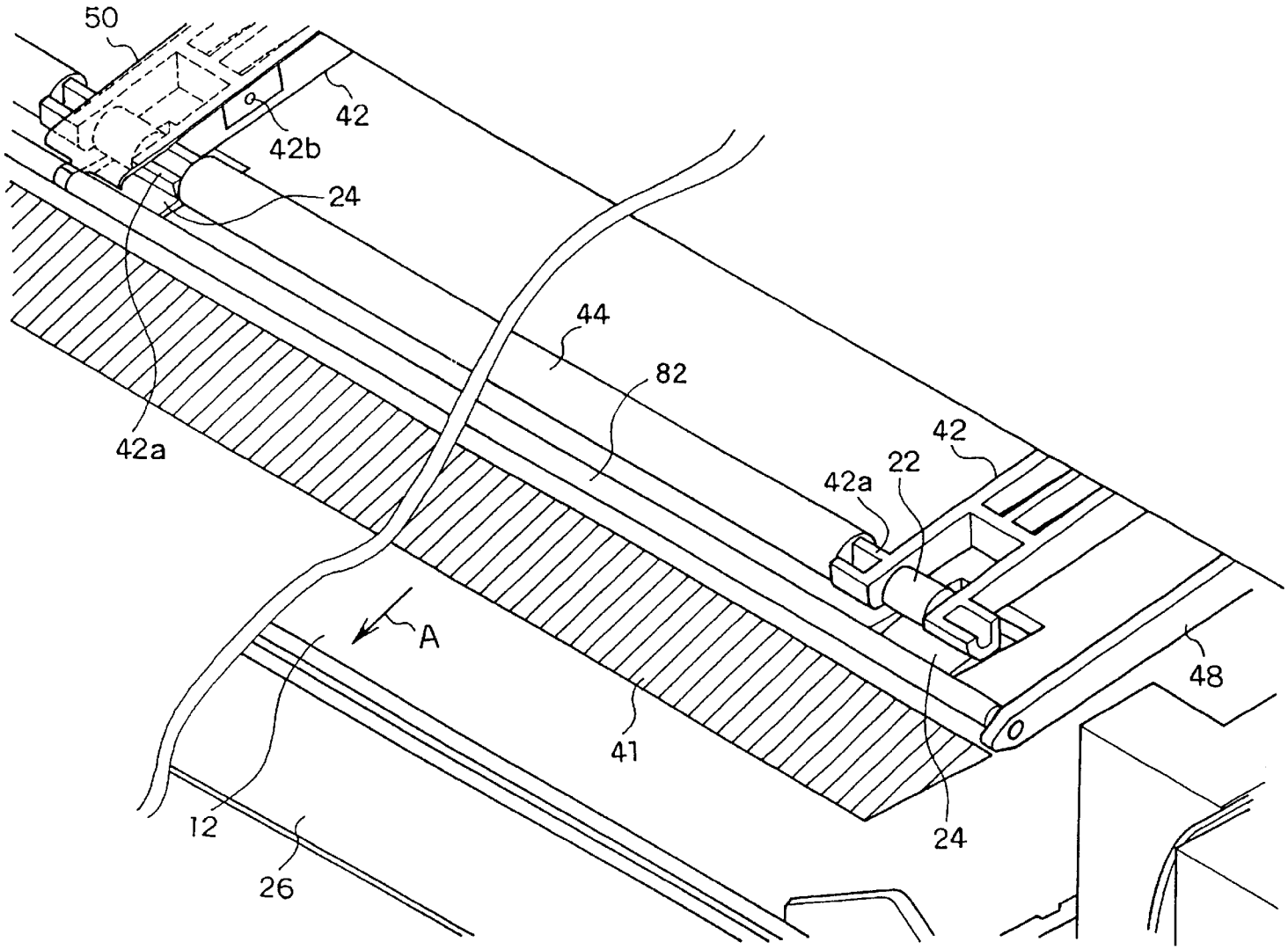
FIG. 11 is an enlarged perspective view of two sheet-pressing member.
Figure 12:
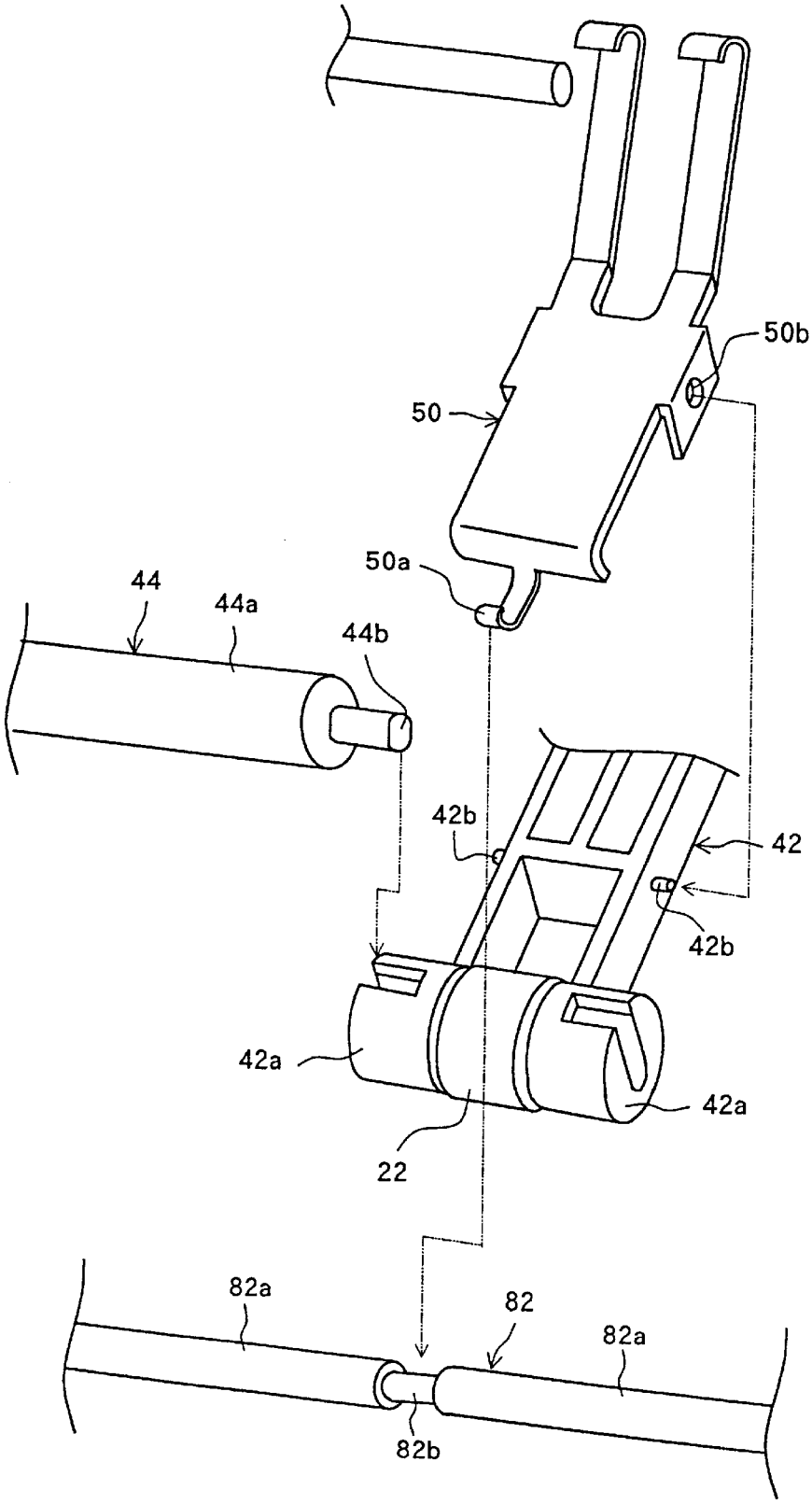
FIG. 12 is a perspective view of the disassembled state of the two sheet-pressing member.
Figure 13:
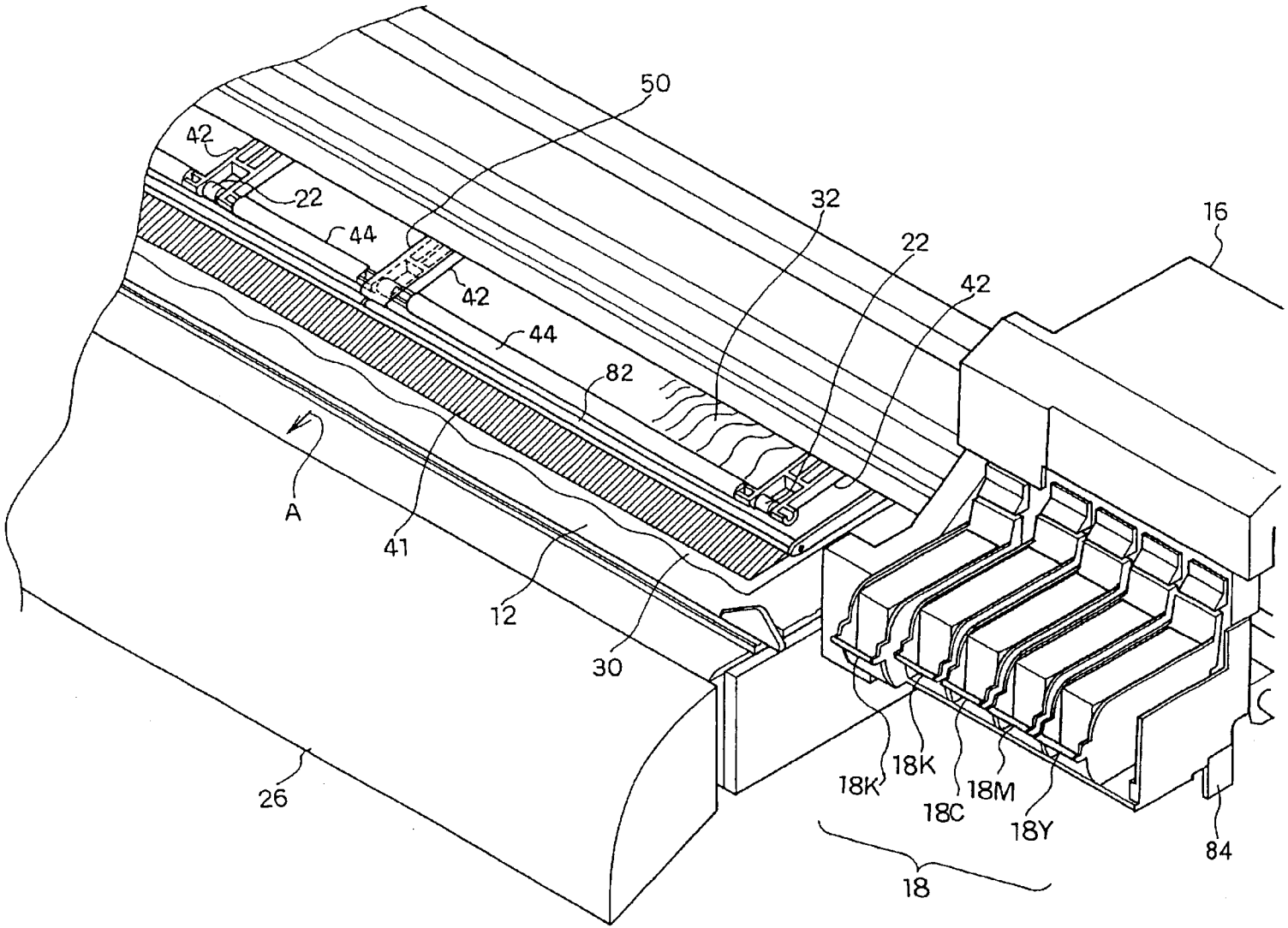
FIG. 13 is a schematic view of the state of suppressing the waviness of a recording medium.

FIG. 9 is a perspective view illustrating a plotter which is an example of the ink-jet type image-forming apparatus of the present invention. FIG. 10 is a perspective view of a part of the delivery roller. FIG. 11 is an enlarged perspective view of two sheet-pressing member. FIG. 12 is a perspective view of the disassembled state of the two sheet-pressing member. FIG. 13 is a schematic view of the state of suppressing the waviness of a recording medium. In these drawings, the same symbols are used to represent the corresponding constitutional elements as in FIGS. 33–36.

In a plotter 80, the recording medium is held between delivery rollers 24 (an example of the driving roller of the present invention) and pinch rollers 22, and is delivered toward a sheet discharge guide 26. An image is formed by ejecting an ink onto a recording medium at the region (image formation zone 41) placed between a printing head 18 and a platen 12.

The plural delivery rollers 24 are fixed, as shown in FIG. 10, at certain distances to a rolling axis 24*a* extending in the main scanning direction perpendicular to the recording medium delivery direction (arrow A direction), and are placed upstream before the image formation zone 41 in the recording medium delivery direction. The rolling axis 24*a* is connected to a delivery motor (not shown in the drawing) to rotate the delivery rollers 24 by rotation of the delivery motor.

Above the delivery rollers 24, a pinch roller 22 is provided respectively. Each of the pinch rollers 22 is fixed rollably to the tip portion of the respective pinch roller arms 42. Between the adjacent pinch rollers 22, a sheet-pressing roller 44 is provided coaxially with the pinch rollers 22. This sheet-pressing roller 44 has a larger-diameter portion 44*a* and a smaller-diameter axis portion 44*b*. The larger-diameter portion 44*a* presses down the portion of the recording medium on the platen 12. Therefore, the rise of this portion of the recording medium caused by the ejected ink is suppressed by this larger-diameter portion 44*a*. The smaller-diameter axis portion 44*b* fits to a bearing portion 42*a* of the pinch roller arm 42 as shown in FIG. 12.

The bearing portion 42*a* of the pinch roller arm 42 is in a shape of a hole having a vertically long cross-section (longer in the direction of attaching to the platen 12 as shown in FIG. 12). Therefore, the axis portion 44*b* of the sheet-pressing roller 44 is movable vertically inside the bearing portion 42*a*, which enables the sheet-pressing roller 44 to move vertically. Therefore, the delivered recording sheet can be pressed down readily to suppress the rising regardless of the thickness of the recording sheet.

The image formation zone 41 is placed downstream after the sheet-pressing roller 44. A sheet-controlling member 82 (an example of the rise-suppressing member of the present invention) is provided to control the recording medium not to rise between the sheet-pressing roller 44 and the image formation.zone 41. This sheet-controlling member 82 is in a shape of a cylinder extending in the main scanning direction, having a length larger than the breadth of the largest size of the recording medium applicable to the plotter 80.

The sheet-controlling member 82 has a larger-diameter portion 82*a* and a smaller-diameter portion 82*b* as shown in FIG. 12. The larger-diameter portion 82*a* presses the recording sheet down on the portion of the recording sheet placed on the platen 12. Therefore, the rise of this portion of the recording medium caused by the ejected ink is prevented by this larger-diameter portion 82*a*. Both of the length ends of the sheet-controlling member 82 are held rollably by an arm member 48 extending in the arrow-A direction as shown in FIG. 11.

The smaller-diameter portion (axis portion) 82*b* of the sheet-controlling member 82 is fit into a bearing portion 50*a* of a holding member 50 as shown in FIG. 12. The holding member 50 is fixed to hang over a pinch roller arm 42 as shown in FIG. 11. For this fixation, projections 42*b* formed in the pinch roller arm 42 are fit into holes 50*b* formed in the holding member 50.

During image formation by ink ejection on a recording paper sheet 30, waviness 32 may occur upstream before the image formation zone 41 in the recording medium delivery direction as shown in FIG. 13. Of the waviness 32, the portion caused upstream before the sheet-pressing roller 44 in the recording sheet delivery direction (upstream waviness) can be suppressed by the sheet-pressing roller 44 during passage of the recording medium under the sheet-pressing roller 44. Thereby, the rise of the recording sheet caused by the upstream waviness can be suppressed, and the recording sheet with the waviness nearly canceled is delivered downstream beyond the sheet-pressing roller 44 in the recording medium delivery direction.

On the other hand, the waviness occurring between the sheet-pressing roller 44 and the sheet-controlling member 82 (downstream waviness) is pressed by the sheet-controlling member 82 during passage of the recording medium under the sheet-controlling member 82. Thereby, the rise of the recording sheet by the downstream waviness is prevented, and the recording sheet is delivered downstream beyond the sheet-controlling member 82 with the upstream waviness nearly canceled. Consequently, the recording medium is delivered in a nearly flat state to the image formation zone 41 without contact with the printing head 18 or hooking thereby.

In running the plotter 80 for a long term, ink mist deposits and accumulates onto the sheet-controlling member 82. This ink mist deposition is explained by reference to FIGS. 14 and 15.

Figure 14:
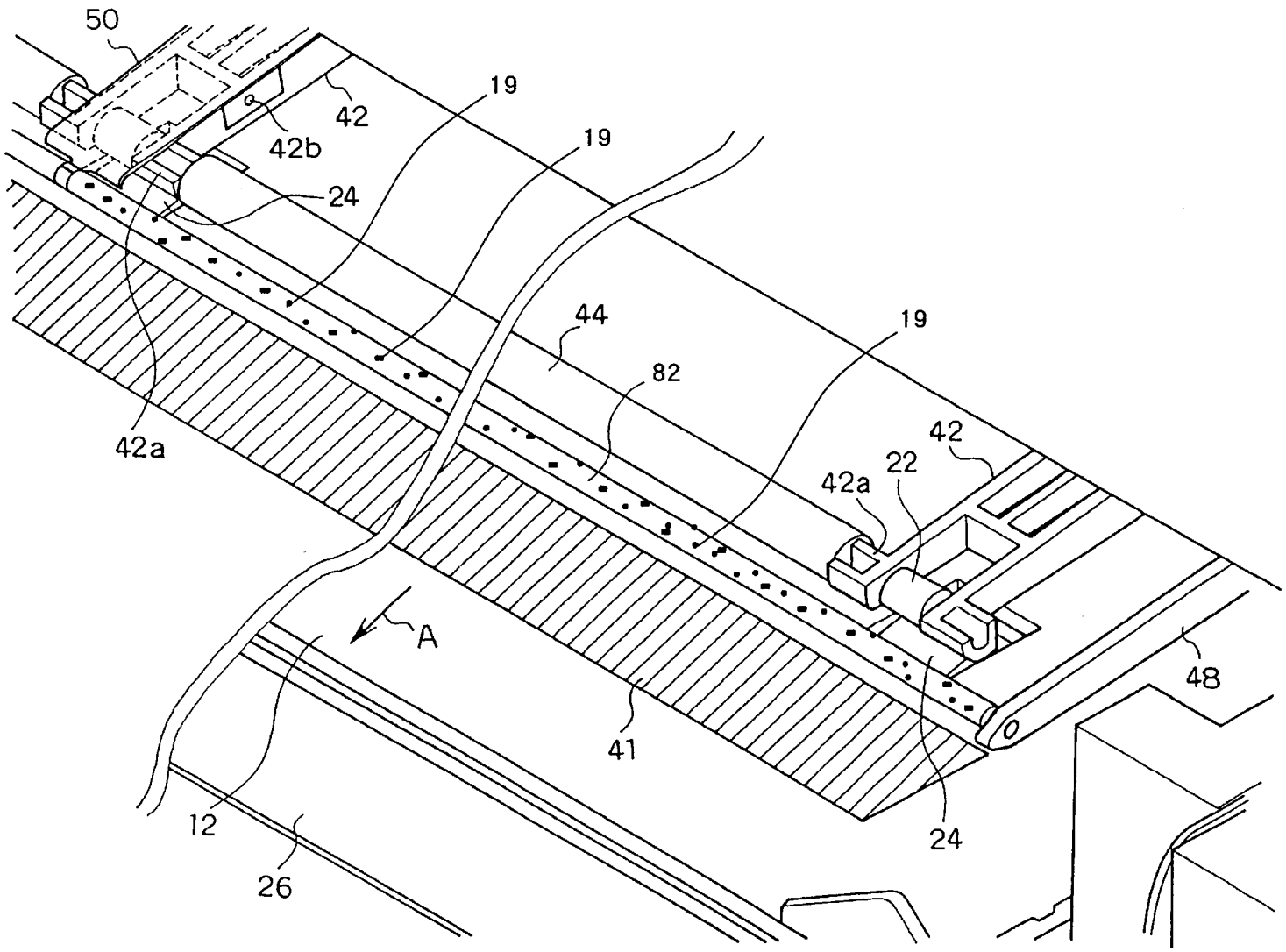
FIG. 14 is a perspective view of the sheet-controlling member having been soiled by ink mist.
Figure 15:
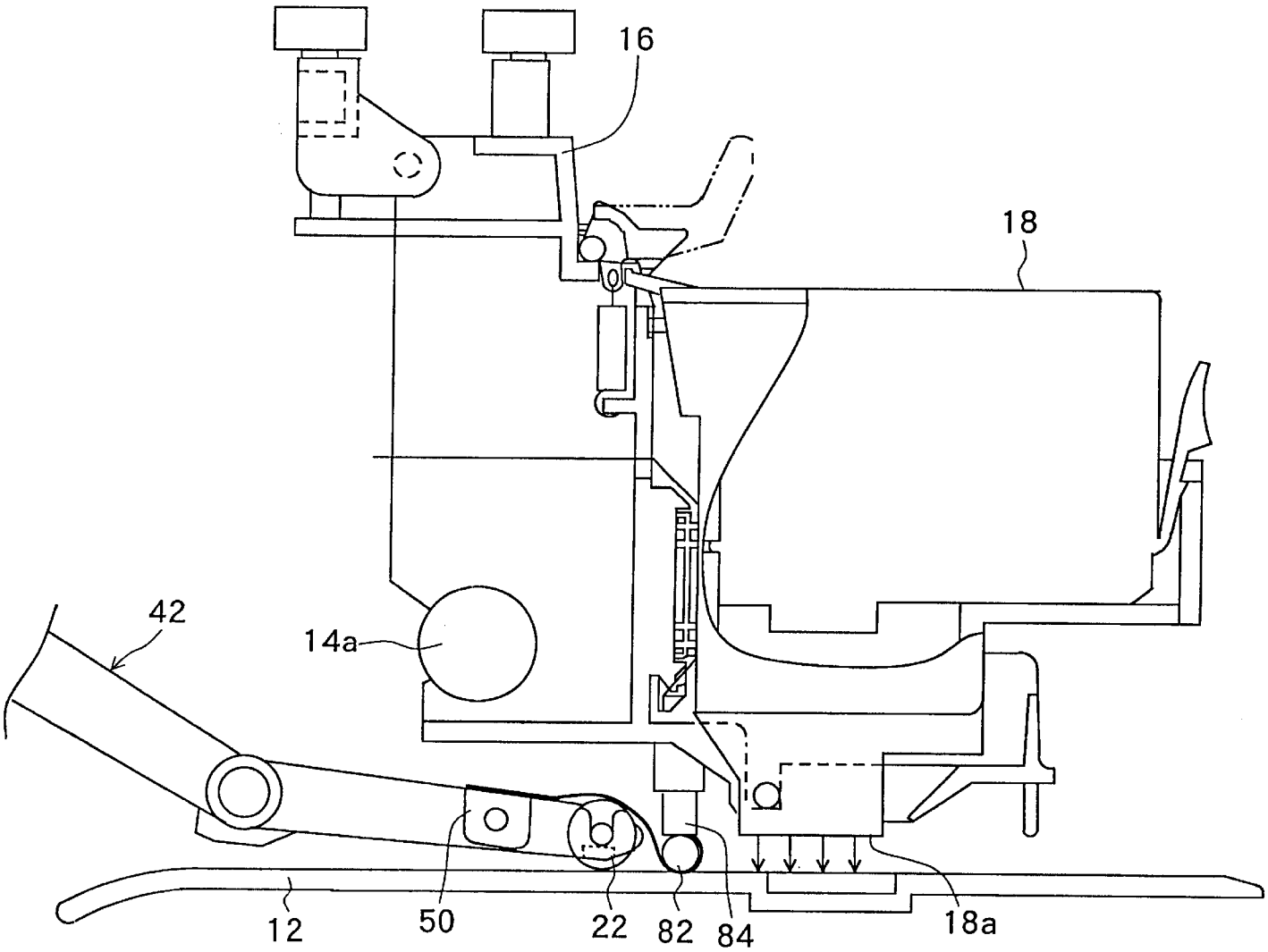
FIG. 15 is a lateral view illustrating a state of removal of the deposited ink mist from the sheet-controlling member.

FIG. 14 is a perspective view of the sheet-controlling member having been soiled by ink mist. FIG. 15 is a lateral view illustrating a state of removal of the deposited ink mist from the sheet-controlling member. In these drawings, the same symbols are used for representing corresponding constitutional elements as in FIGS. 9–13.

In running of the plotter 80 for a long term, mist of the ink ejected from the printing head 18 deposits as ink mist 19 on the sheet-controlling member 82. A rising portion of the recording medium may come into contact with the sheet-controlling member 82. This causes staining of the recording medium by adhesion of the ink mist 19 onto the recording medium. The stained sheet-controlling member 82 is cleaned by removing the deposited ink mist 19 by a cleaning member 60 fixed to the carriage 16 as shown in FIG. 9 and FIG. 13.

The cleaning member 84 is constituted of a sponge or a like material capable of absorbing the ink, and is in a plate shape. The cleaning member 84 is fixed to the carriage 16 to be slidable on the sheet-controlling member 82 with reciprocating movement of the carriage 16 in the main scanning direction as shown in FIG. 15. Therefore, with the reciprocating movement of the carriage in the main scanning direction, the cleaning member 84 removes deposit of the ink mist 19 from the sheet-controlling member 82. In this example, the cleaning member 84 is fixed to the carriage 16 so that the cleaning member 84 cleans incessantly the sheet-controlling member 82 with the reciprocation of the carriage 16 in the main scanning direction. However, cleaning member 84 may be constituted to be protrudable as necessary to conduct cleaning of the sheet-controlling member 82.

Another example of the cleaning member is explained by reference to FIGS. 16–18.

Figure 16:
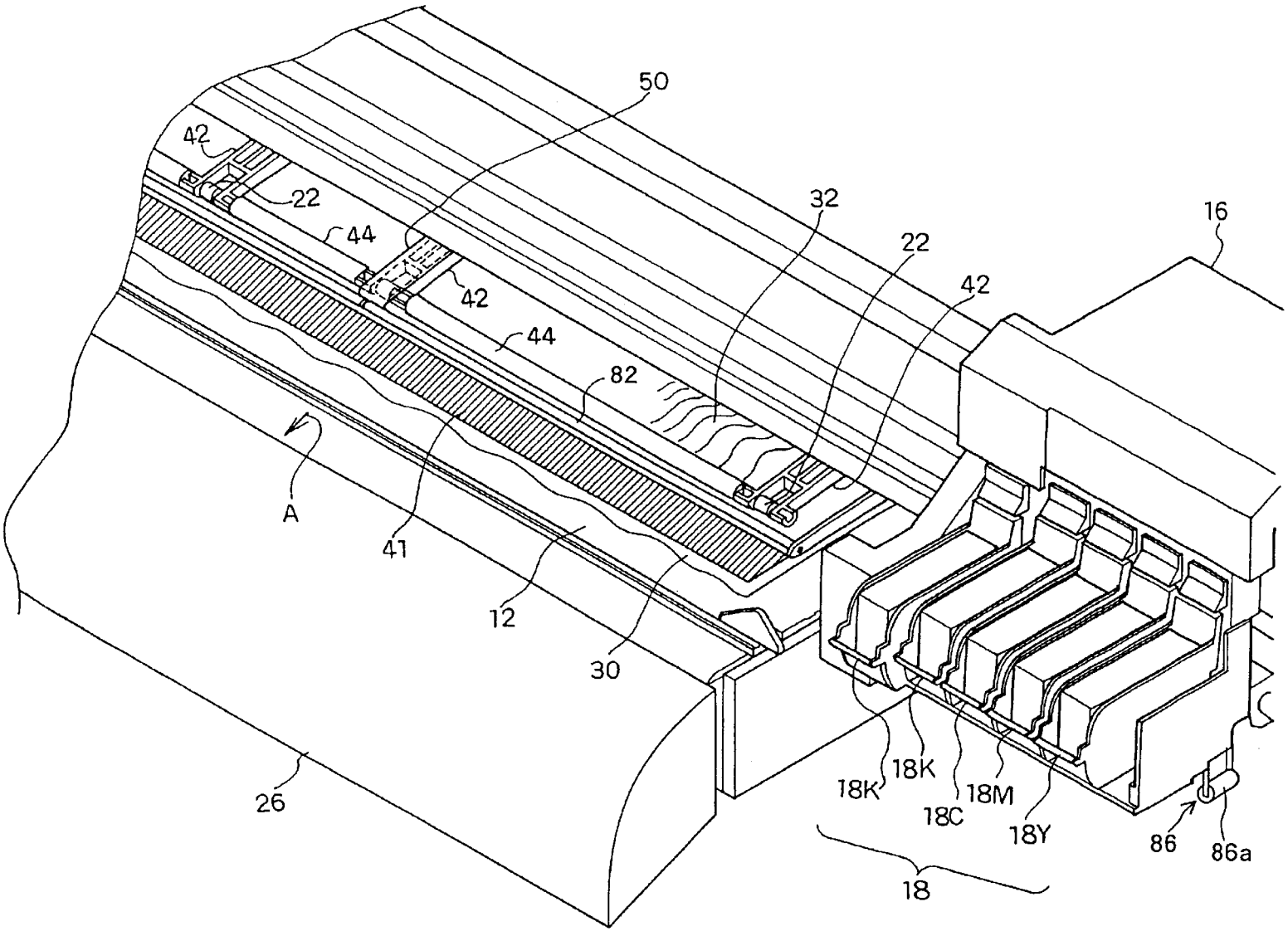
FIG. 16 is a perspective view showing a carriage provided with a rotary cleaning member in place of a plate-shaped cleaning member.

FIG. 16 is a schematic perspective view of a carriage provided with a rotary cleaning member in place of a plate-shaped cleaning member. FIG. 17 is a perspective view of a printing head having a plate-shaped cleaning member. FIG. 18 is a perspective view of a printing head having a rotary cleaning member fixed thereto.

The cleaning member 86 shown in FIG. 16 is fixed to the bottom end of the carriage 16 to be rollable. This cleaning member 86 has a structure of a roller, and the cleaning roller 86*a* rolls freely. With reciprocating movement of the carriage 16 in the main scanning direction, the cleaning roller 86*a* rolls to wipe the ink mist 19 from the sheet-controlling member 82 (see FIG. 14). The cleaning roller 86*a* is constituted of a sponge or a like material capable of absorbing the ink.

Figure 17:
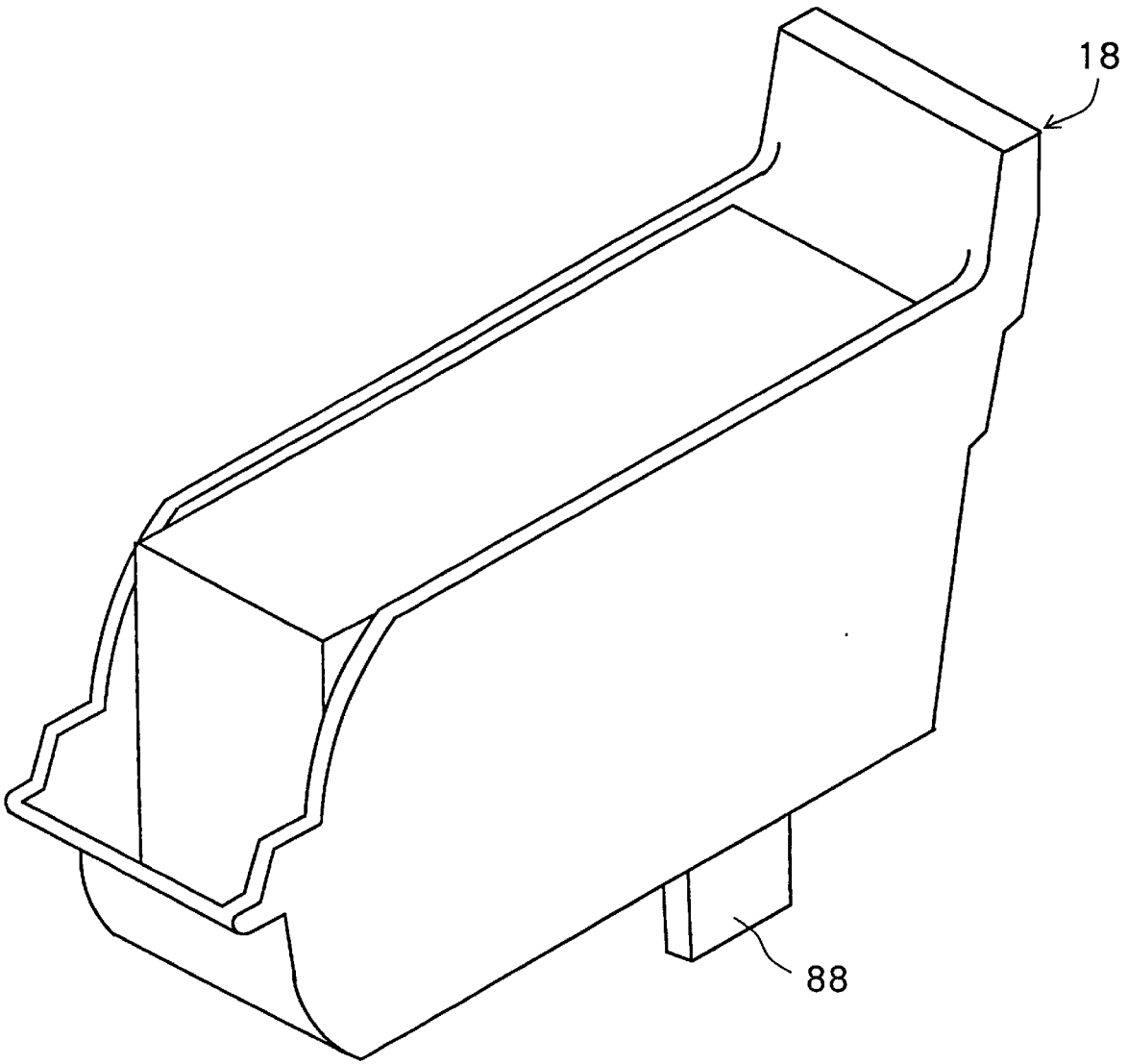
FIG. 17 a perspective view of a printing head having a plate-shaped cleaning member fixed thereto.

The cleaning member 88 shown in FIG. 17 is fixed to the bottom end of the printing head 18. This cleaning member 88 is constituted of a sponge or a like material capable of absorbing the ink. The printing head 18 is demountable from the carriage 16 (see FIG. 9). Therefore, the cleaning member 88 is exchanged simultaneously with the exchange of the printing head 18. This ensures the cleaning of the sheet-controlling member 82 to remove the ink mist 19 (see FIG. 14).

Figure 18:
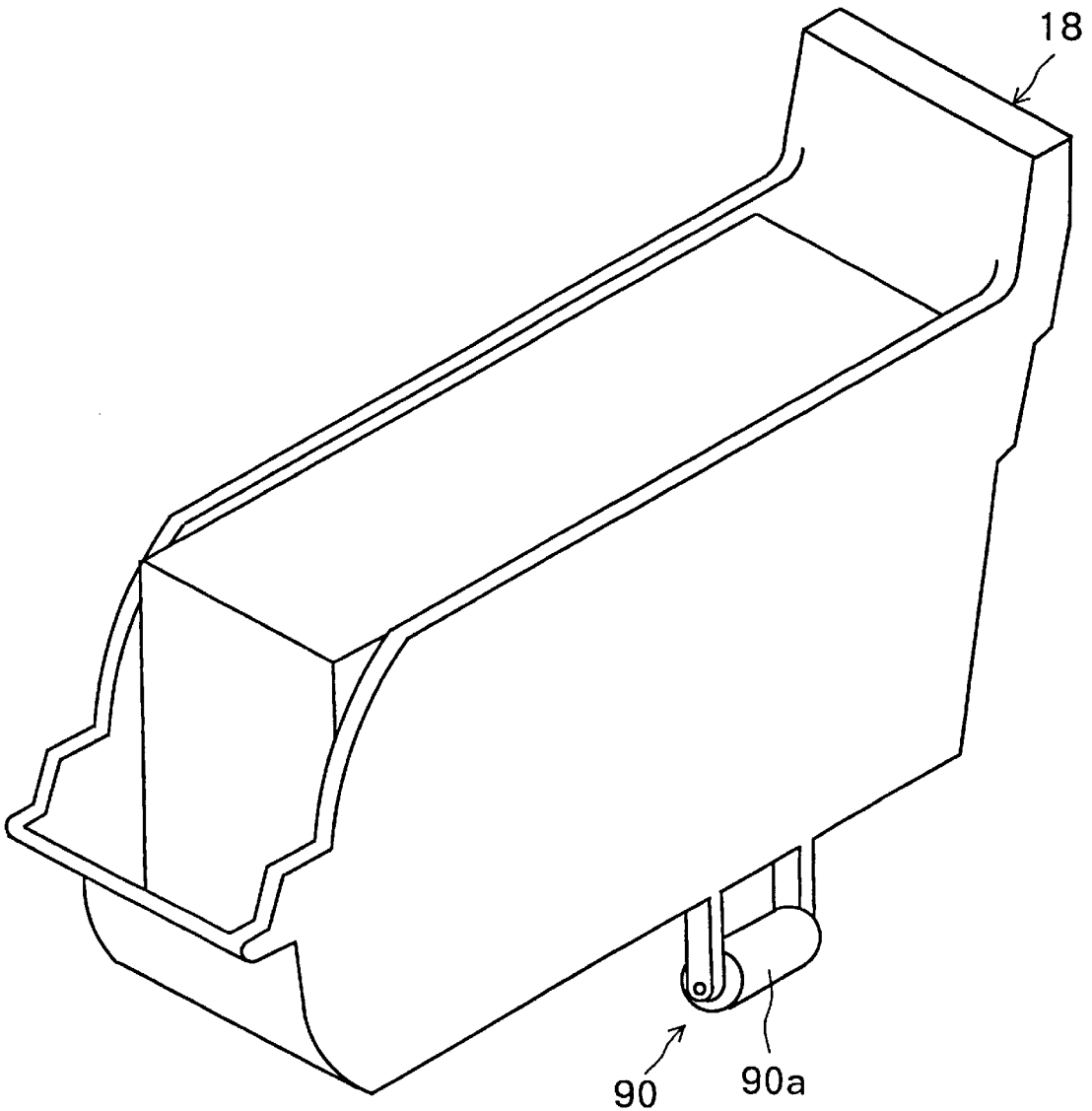
FIG. 18 is a perspective view of a printing head having a rotary cleaning member fixed thereto.

The cleaning member 90 shown in FIG. 18 is fixed to the bottom end of the printing head 18 and is rollable. This cleaning member 90 has a structure of a roller, and the cleaning roller 90*a* rolls freely. With reciprocating movement of the printing head 18 with the carriage 16 (see FIG. 9) in the main scanning direction, the cleaning roller 90*a* rolls to wipe the ink mist 19 (see FIG. 14) from the sheet-controlling member 82. The cleaning roller 90*a* is constituted of a sponge or a like material capable of absorbing the ink. The printing head 18 is demountable from the carriage 16 (see FIG. 9). Therefore, the cleaning member 90 is exchanged simultaneously with the exchange of the printing head 18. This ensures the cleaning of the sheet-controlling member 82 to remove the ink mist 19 (see FIG. 14).

In the above example, the ink mist 19 adheres only to the sheet-controlling member 82. However, the ink mist 19 may adhere also to the members or parts in the periphery of the sheet-controlling member 82. The countermeasure in this case is explained below by reference to FIGS. 19–23.

Figure 19:
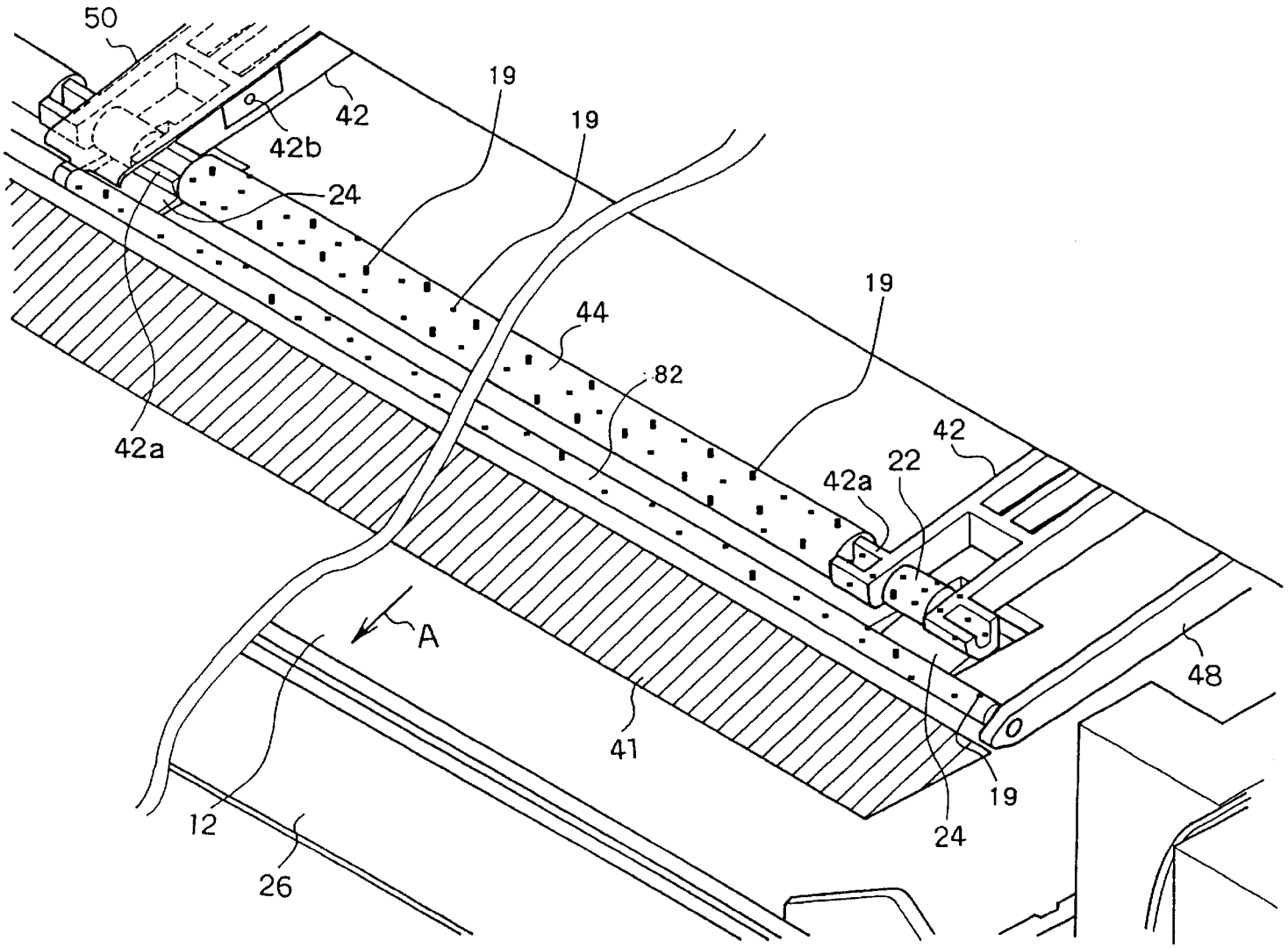
FIG. 19 is a perspective view of the sheet-controlling member, pinch rollers, and other members having been soiled by ink mist.
Figure 20:
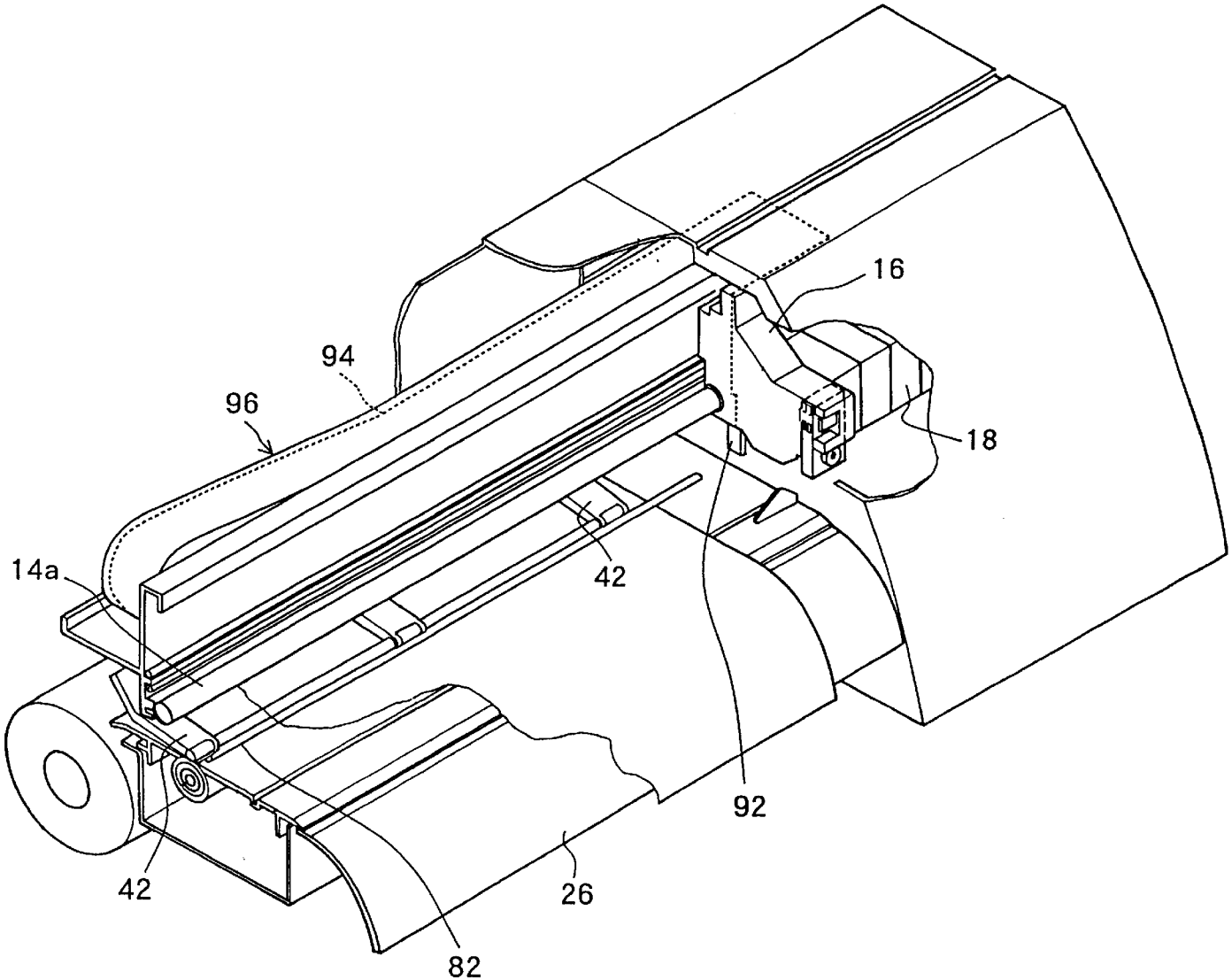
FIG. 20 is a perspective view illustrating a cleaning member for removal of deposited ink mist from the sheet-controlling member.
Figure 21:
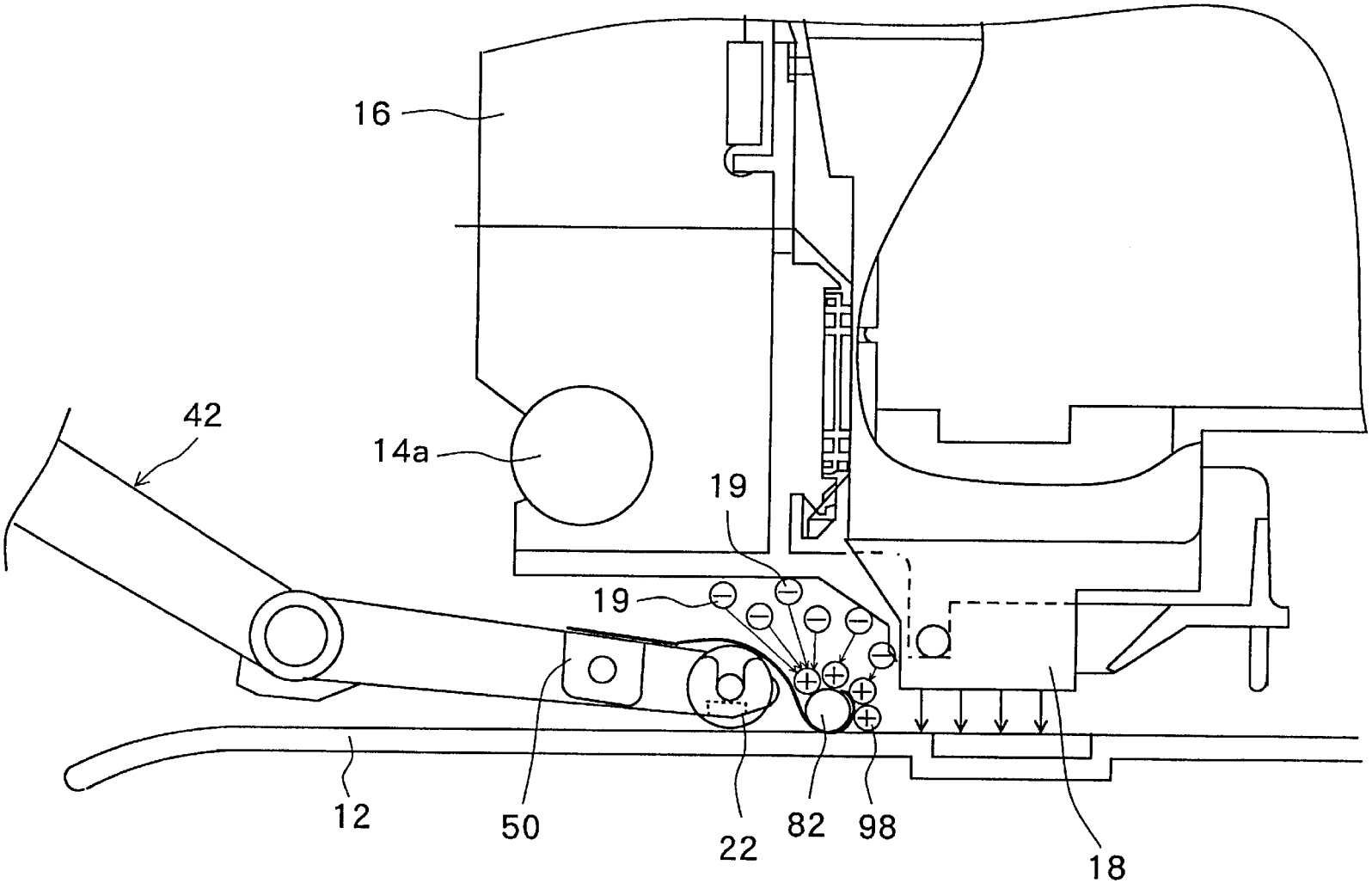
FIG. 21 is a lateral view illustrating schematically a state of accumulation of ink mist onto the sheet-controlling member.
Figure 22:
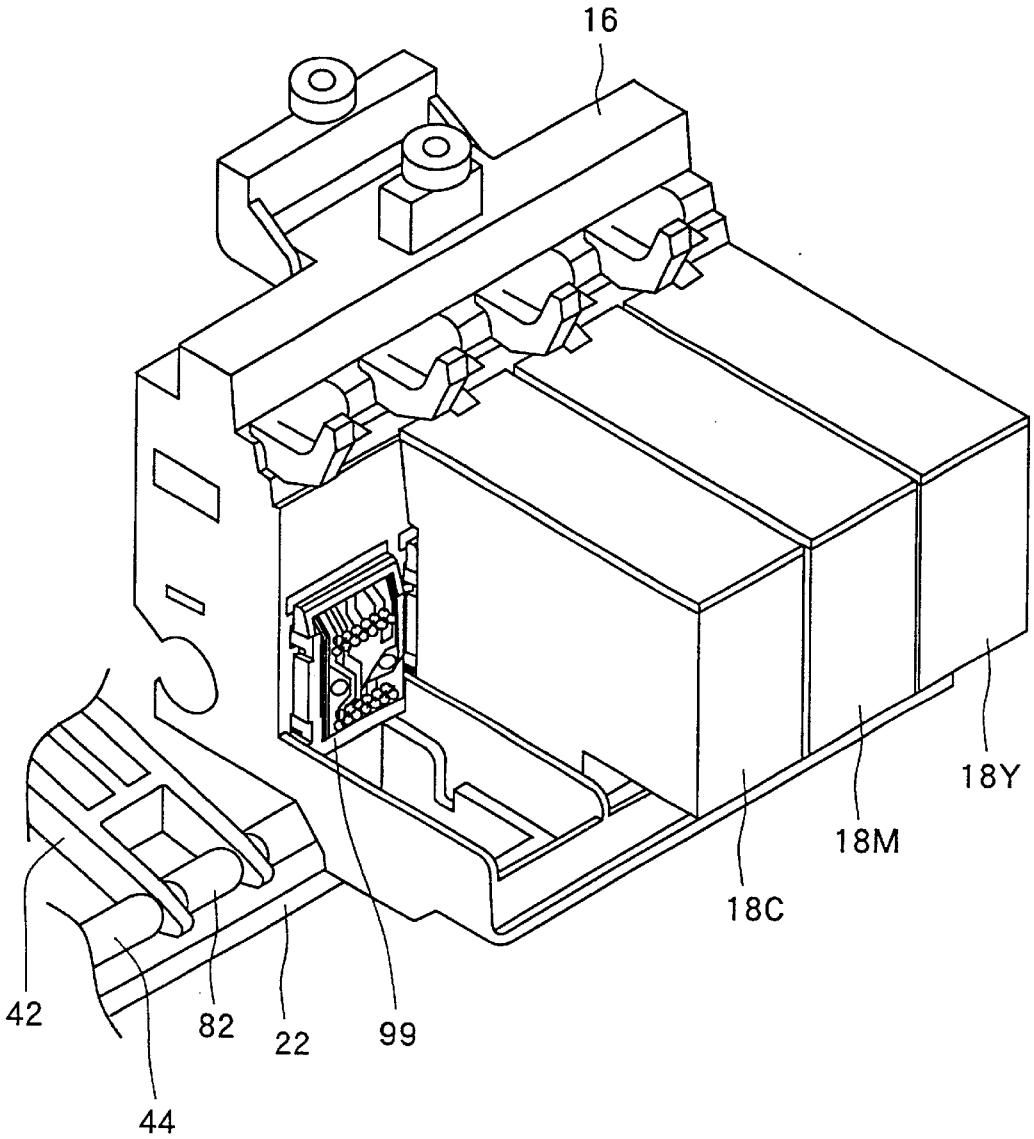
FIG. 22 is a perspective view of a carriage with one printing head taken away.
Figure 23:
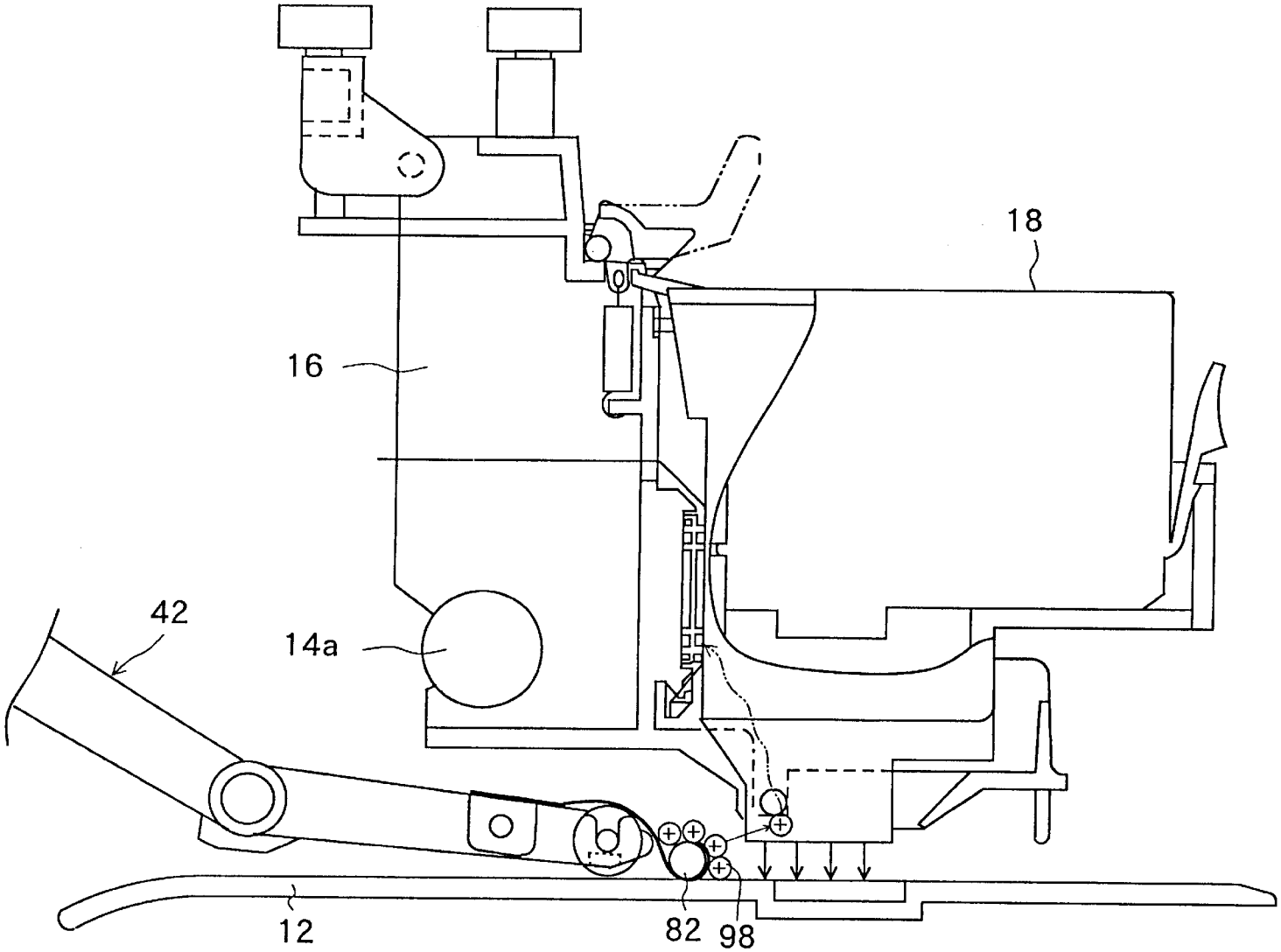
FIG. 23 is a schematic lateral view illustrating discharge of electric charge accumulated in the sheet-controlling member.

FIG. 19 is a perspective view of the sheet-controlling member, pinch rollers, and other members having been soiled by ink mist. FIG. 20 is a perspective view illustrating a cleaning member for removal of the deposited ink mist from the sheet-controlling member. FIG. 21 is a lateral view illustrating schematically a state of accumulation of ink mist onto the sheet-controlling member. FIG. 22 is a perspective view of a carriage with one printing head taken away. FIG. 23 is a schematic lateral view illustrating discharge of electric charge accumulated in the sheet-controlling member. In these drawings, the same symbols are used to indicate corresponding constitutional elements as in FIGS. 9–18.

In running of the plotter 80 (see FIG. 9) for a long term, mist of the ink ejected from the printing head 18 can deposits as ink mist 19 on the sheet-controlling member 82, pinch rollers 22, pinch roller arms 42, sheet-pressing member 44, and other members. The ink mist 19 having deposited on the sheet-controlling member 82, pinch rollers 22, and so forth may stain the recording medium (offsetting). Further, the ink mist 19 adhering to the pinch rollers 22 may cause slippage of the recording medium delivered through between the pinch rollers 22 and the delivery rollers 24. To solve such problems, another embodiment is explained below. This embodiment is characterized in that a cleaning member 92 (an example of the static eliminator of the present invention) is fixed to the bottom end of the carriage 16, and has a static elimination function; and the sheet-controlling member 82 is made of an electric insulating material.

The cleaning member 92 is constituted of a sponge or a like material capable of absorbing the ink, and is in a plate shape. The cleaning member 92 is grounded through a grounding wire 94 as shown in FIG. 20. This grounding wire 94 is embedded in a communication cable (long flexible cable) 96.

In delivery of the recording medium, positive charge 98 is accumulated in the sheet-controlling member 82 owing to the friction between the sheet-controlling member 82 and the recording medium. The electric charge cannot be dissipated and is accumulated continuously in the sheet-controlling member 82 because of the insulating property of the sheet-controlling member 82. Since the ink ejected from the printing head 18 has a negative charge, the ink mist 19 is adsorbed by the sheet-controlling member 82 but is not adsorbed by pinch rollers 22, pinch roller arms 42, sheet-pressing roller 44, and so forth. Consequently, almost the entire of the ink mist 19 adheres to the sheet-controlling member 82. The ink mist 19 adhering thus to the sheet-controlling member 82 is wiped off by the cleaning member 92 similarly as in FIG. 15. In the case where the ink has a positive charge, the material of the sheet-controlling member 82 is selected to be negatively chargeable.

The printing head 18 receives image information through a flexible cable 99 and ejects ink in accordance with the image information as shown in FIG. 22. If the positive charge accumulates excessively in the sheet-controlling member 82, the charge 98 can be discharged to the metallic portion of the printing head to cause malfunction of the apparatus, forming an abnormal image. However, in this embodiment, the cleaning member 92 is grounded by the grounding wire 94, and the electric charge 98 accumulated in the sheet-controlling means 82 is preferentially discharged to the cleaning member 92, and the charge is led out through the grounding wire 94. Therefore, the positive charge will not accumulate excessively in the sheet-controlling member 82, not causing malfunction.

In the above embodiment, the cleaning member 92 is fixed to the carriage 16. However, the cleaning member 92 may be constituted to be protrudable to conduct the cleaning of the sheet-controlling member 82 simultaneously with cutting of the recording medium (cutter operation). The cleaning member 92 in a plate shape may be changed to a rotary cleaning member as shown in FIG. 16. Further, the cleaning member 92 may be fixed to the bottom end of the printing head 18 as shown in FIG. 17 or 18. In this case, the cleaning 70 is grounded through a head flexible cable (not shown in the drawing). The cleaning member 92 which is of a rotary type or is fixed to the printing head 18 gives the same effects as above.

A third embodiment of the present invention is described below by reference to FIG. 24.

Figure 24:
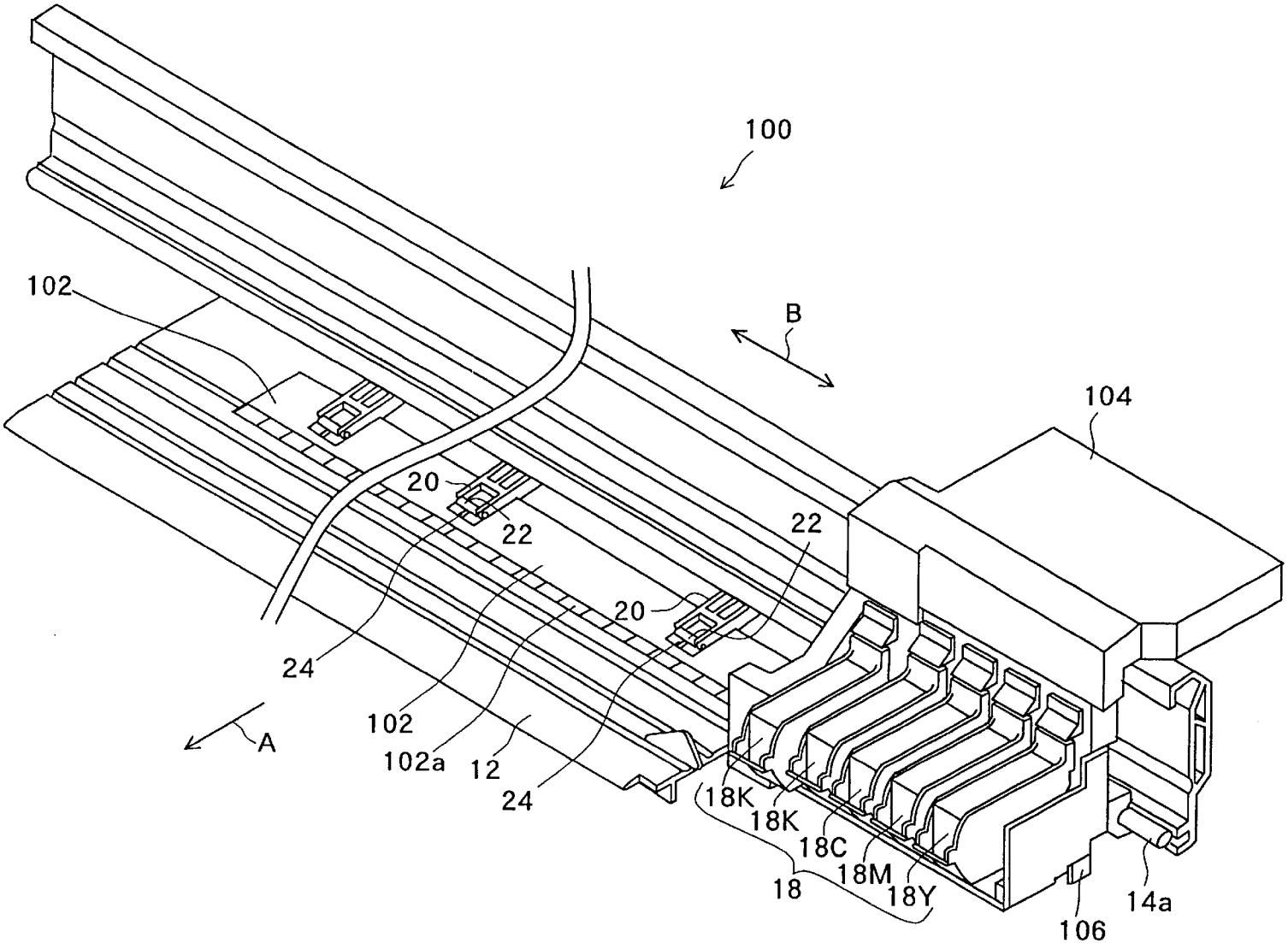
FIG. 24 is a perspective view illustrating roughly the constitution of a plotter of the third embodiment having a carriage with a cleaning member fixed thereon.

FIG. 24 is a perspective view illustrating roughly the constitution of a plotter having a carriage with a cleaning member of the present invention fixed thereon. In FIG. 24, the same symbols are used for representing corresponding constitutional element as in FIG. 33.

The plotter 100 has a Mylar sheet member 102 placed slightly upstream before the image formation zone in the recording medium delivery direction (arrow A direction) to prevent staining by the mist. The sheet member 102 is narrow and long, extending in the arrow B direction. The recording medium is delivered through under this sheet member 102.

In formation of an image on a recording paper sheet, the printing head 18 ejects ink onto a recording sheet while moving together with the carriage 104 in reciprocation in the arrow B direction. A part of the ink ejected from the printing head 18 is scattered in a mist state before reaching the recording sheet to adhere to a deposition area 102*a* (shadowed area) of the sheeting member 102, whereby the deposition area 102*a* become soiled by the ink.

A cleaning member 106 is fixed to the bottom end of the carriage 104 for cleaning the above deposition area 102*a*. This cleaning member 106 reciprocates together with the carriage 104 to wipe the ink adhering to the deposition area 102*a*, as the carriage 104 reciprocates in the arrow B direction. Thereby the sheet member 102 is cleaned, preventing staining of the hand or clothes of the operator. The cleaning member 106 is constituted of a sponge or a like material capable of absorbing the ink. The cleaning 34 may be fixed to the print head 18.

Another example of the cleaning member is explained by reference to FIG. 25.

Figure 25:
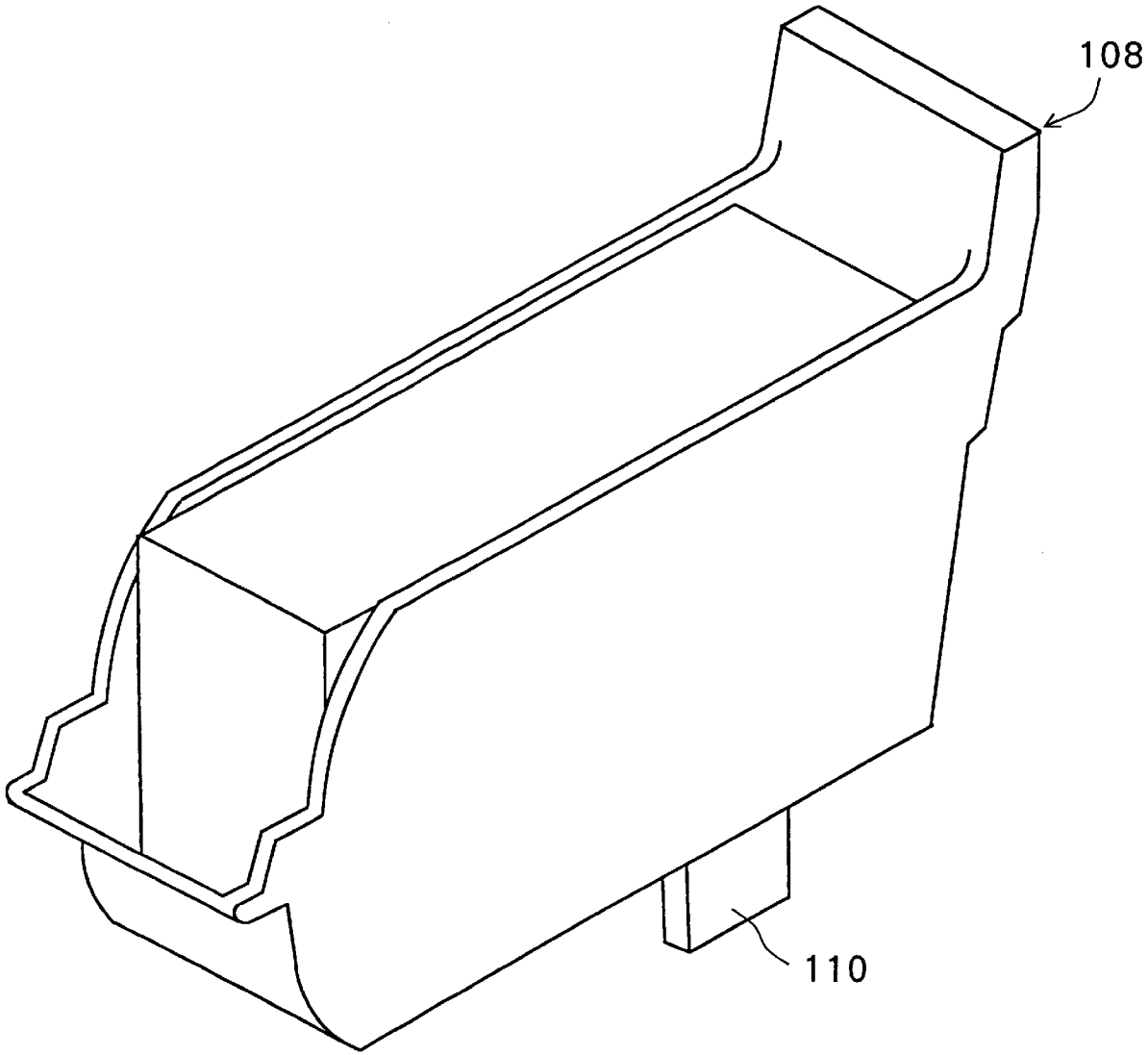
FIG. 25 is a perspective view of a printing head having a cleaning member fixed thereto of another example.

FIG. 25 is a perspective view of a printing head having a cleaning member fixed thereto of another example.

This cleaning member is characterized by fixation of the cleaning member 110 to the bottom end of the printing head 108. The cleaning member 110 cleans the deposition area 102*a* (see FIG. 24). This cleaning member 110 reciprocates together with the carriage 108 by wiping the ink adhering to the deposition area 102*a*, as the carriage 104 reciprocates in the arrow B direction (see FIG. 24). Thereby the sheet member 102 is cleaned to prevent staining of the hand or clothes of the operator. The cleaning member 110 is constituted of a sponge or a like material capable of absorbing the ink.

Figure 33:
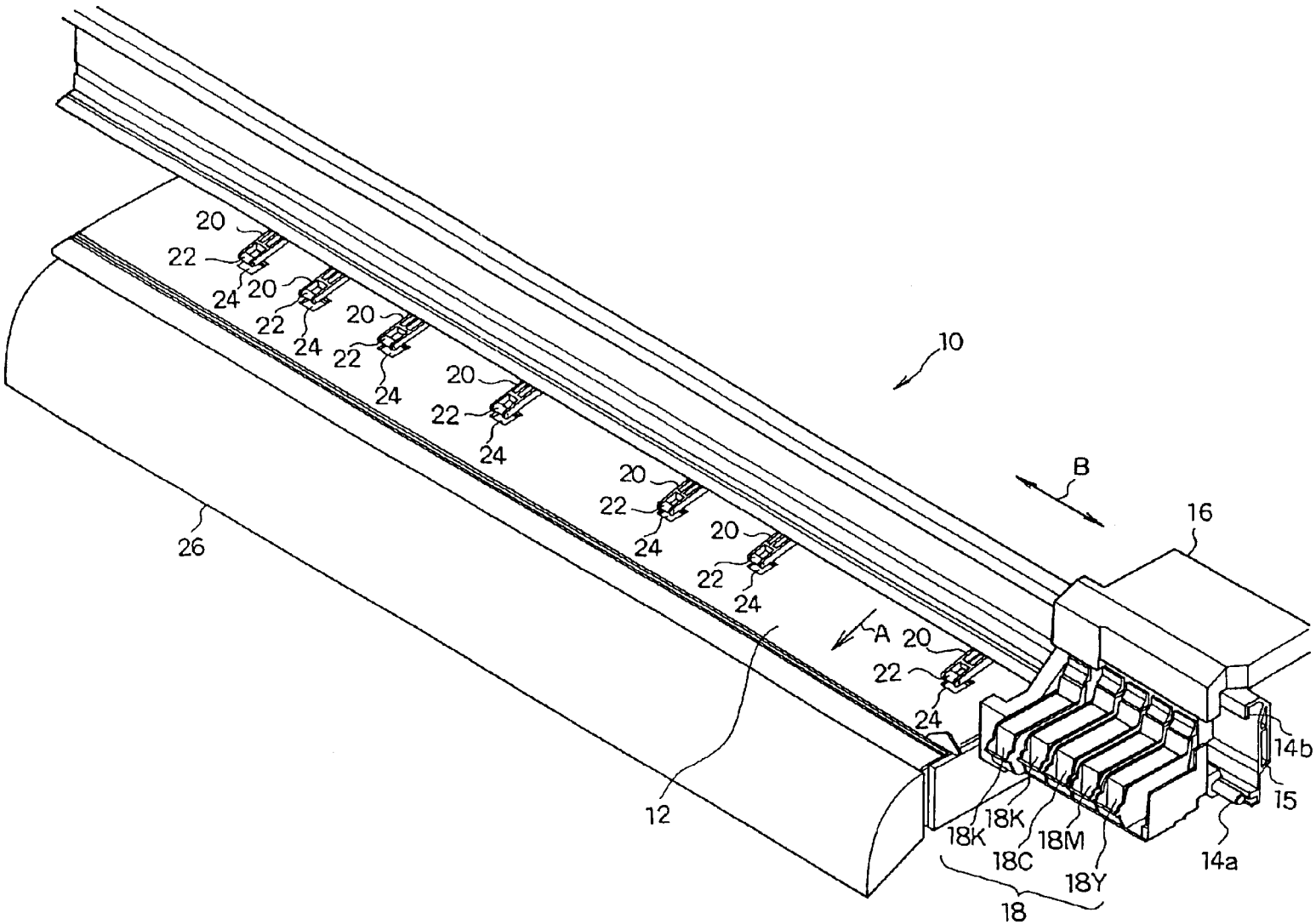
FIG. 33 is a perspective view illustrating roughly a construction of a plotter of a conventional ink-jet type image-forming apparatus.
Figure 34:
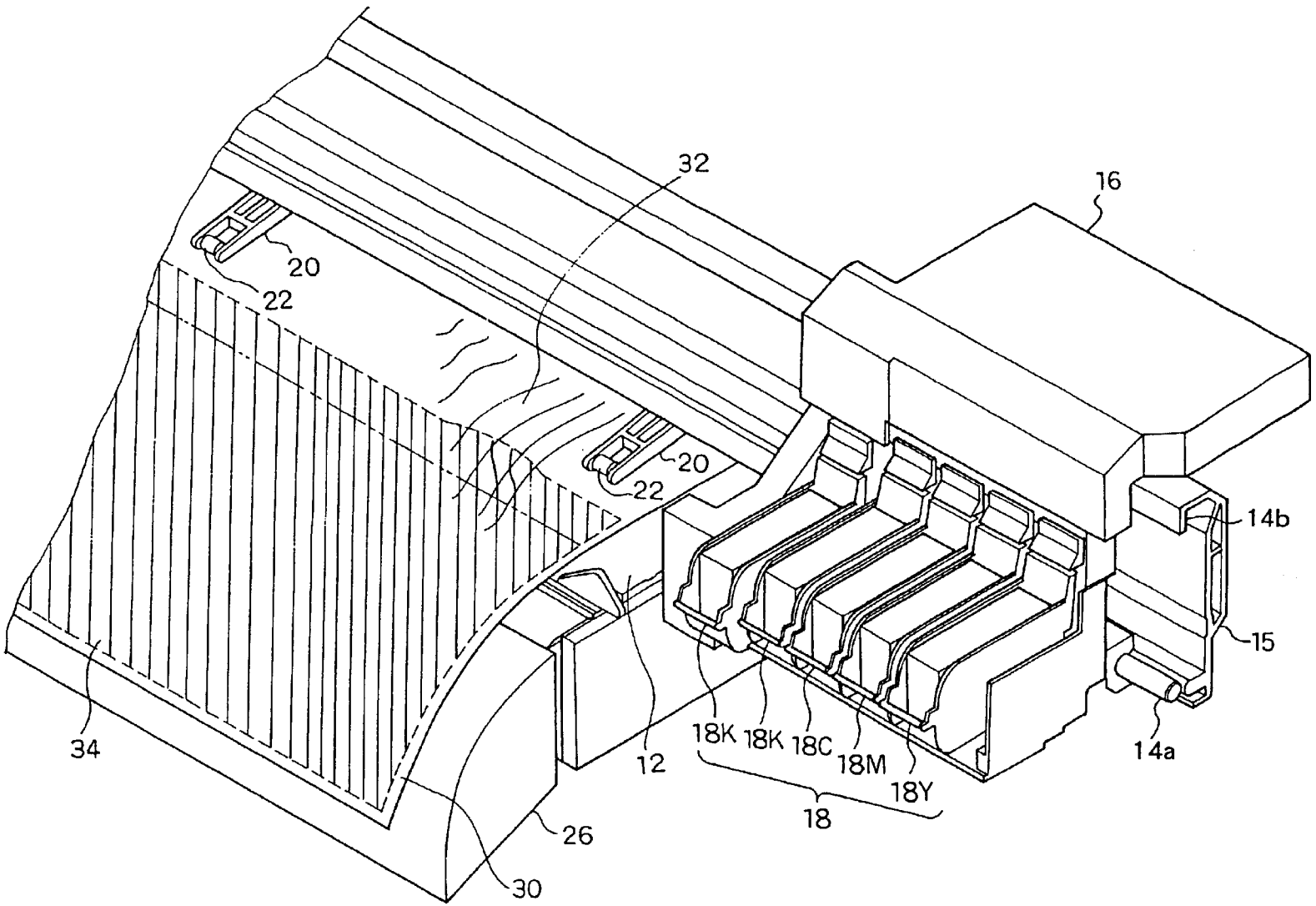
FIG. 34 is a perspective view illustrating occurrence of waviness of a recording sheet.
Figure 35:
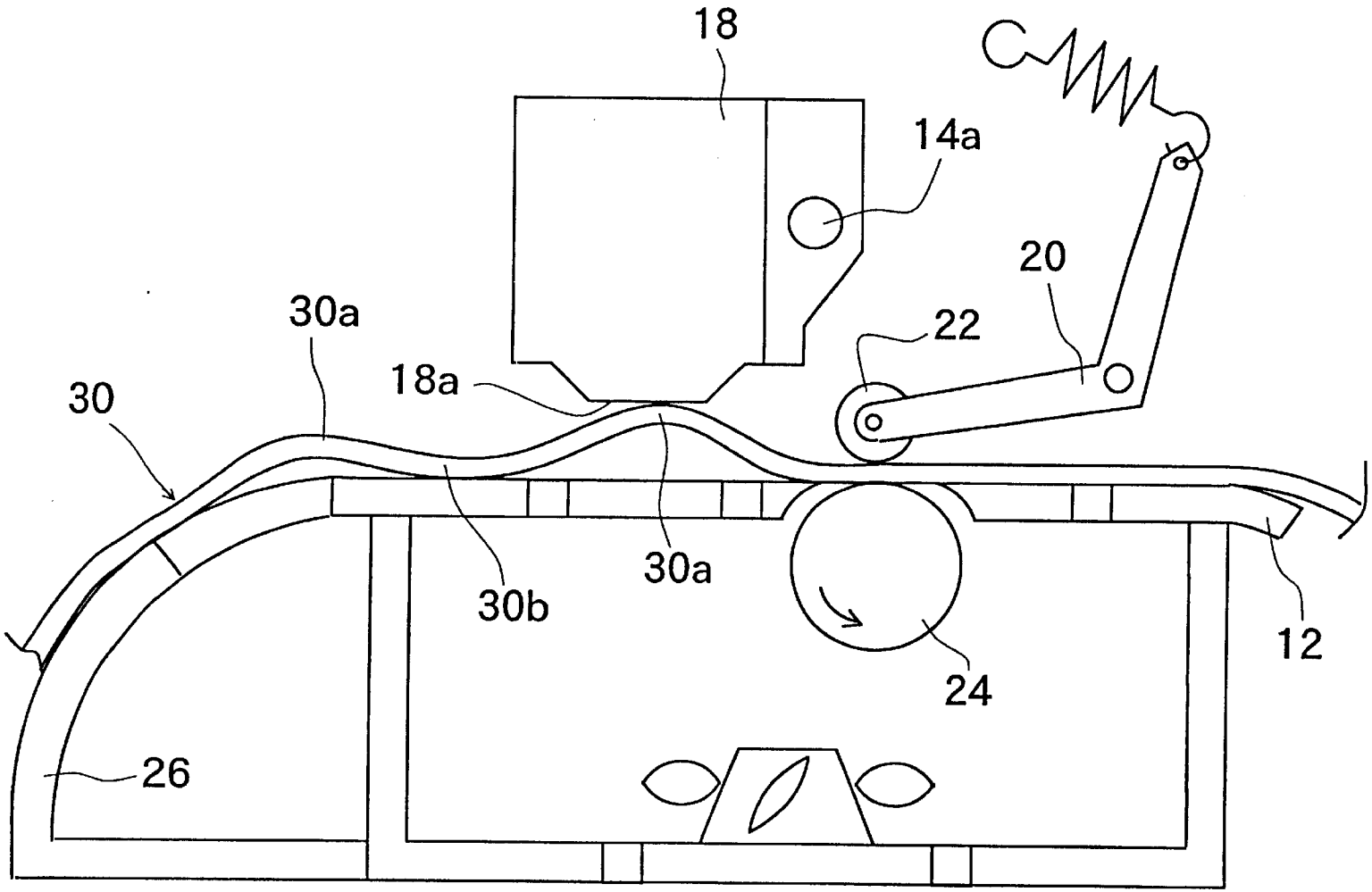
FIG. 35 is a schematic drawing illustrating a rise of a recording medium under a printing head.
Figure 36:
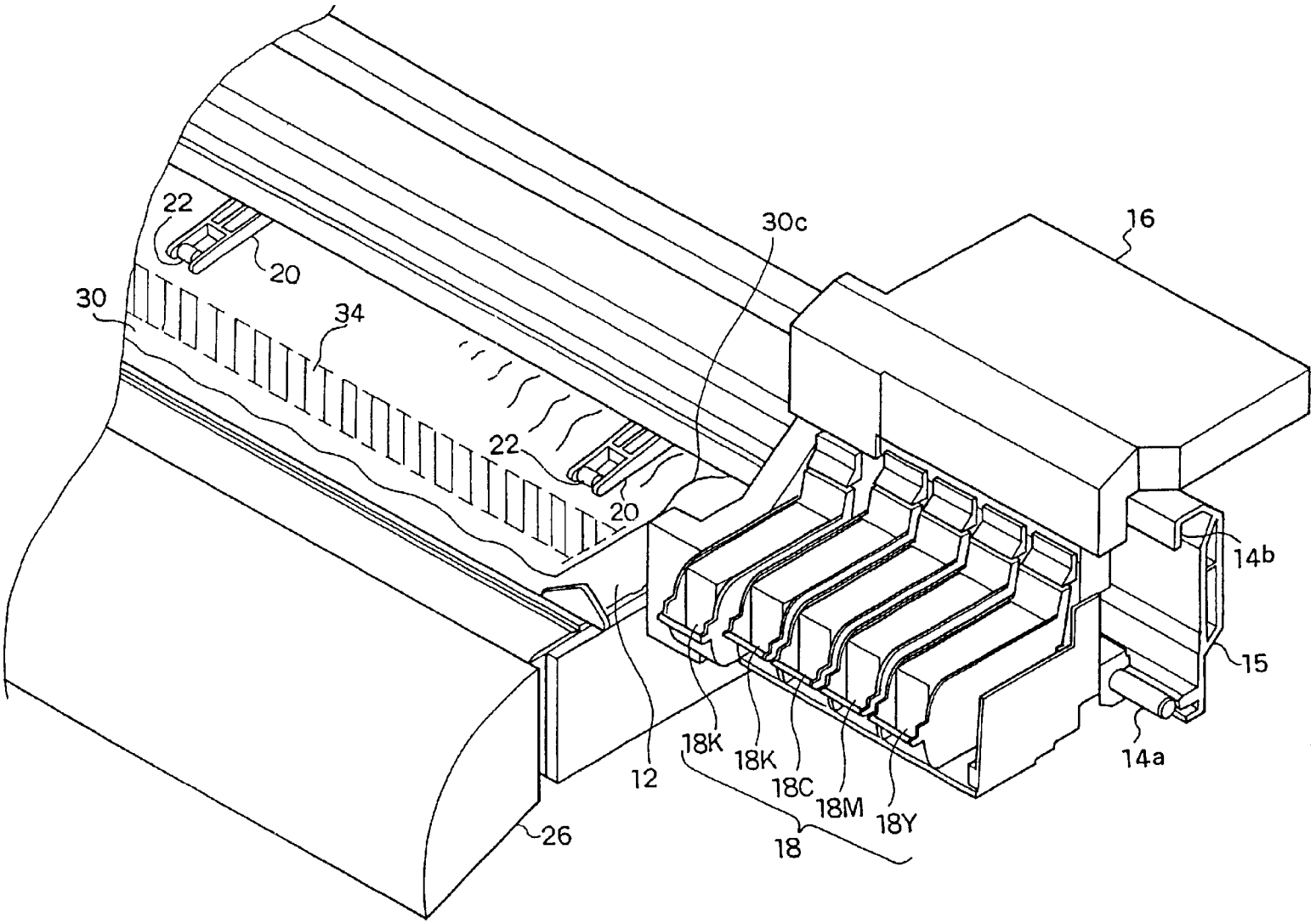
FIG. 36 is a perspective view illustrating occurrence of waviness at the side edge portion of a recording medium.

The printing head 108 is demountable from the carriage 16 (see FIG. 33). Therefore, the cleaning member 110 is exchanged simultaneously with exchange of the printing head 108, which shortens the required service period for one cleaning member 110. Therefore, the sheeting member 102 (see FIG. 24) can be cleaned surely even with a smaller cleaning member 110.

Still another example of the cleaning member is explained below by reference to FIG. 26.

Figure 26:
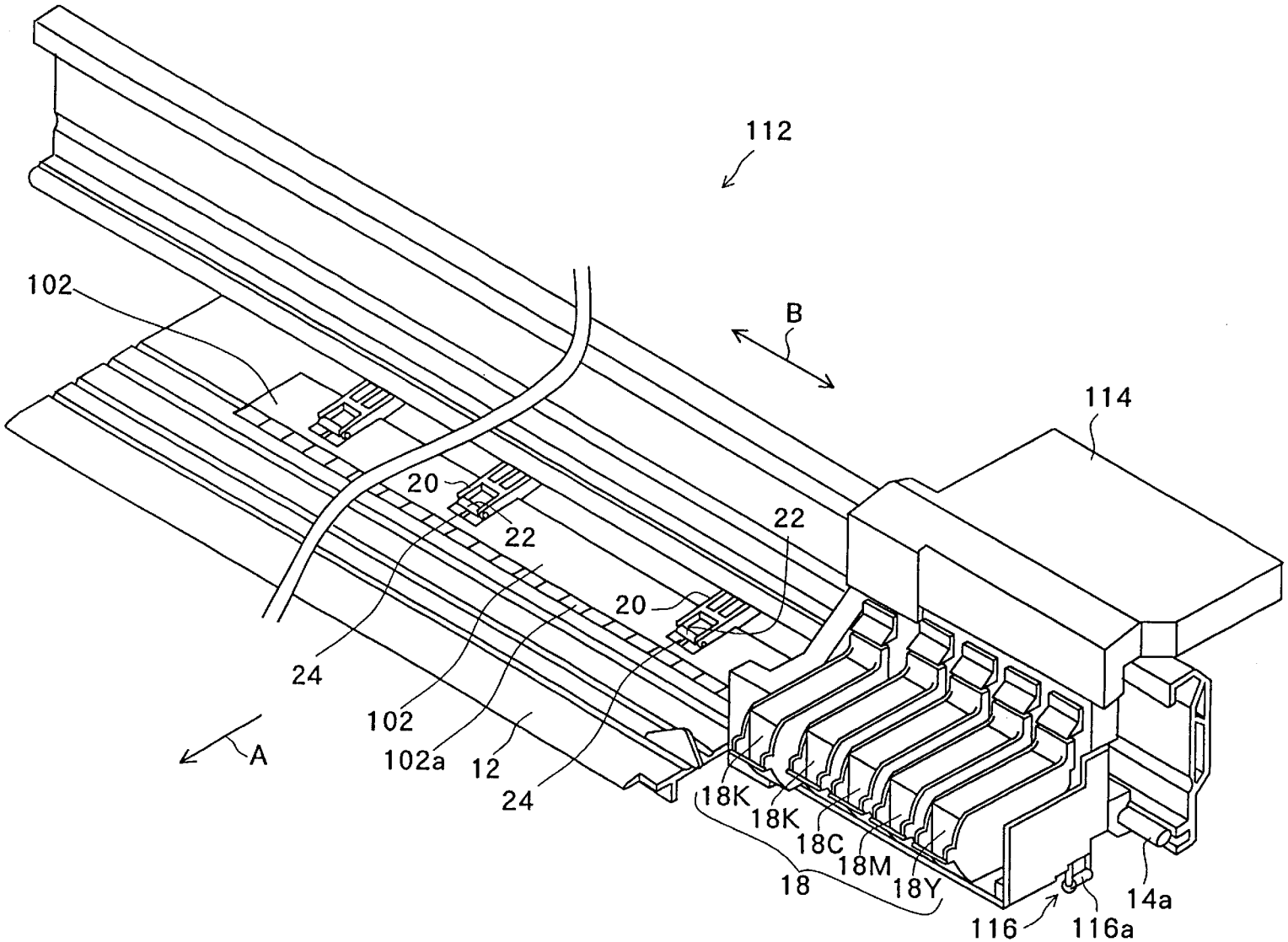
FIG. 26 is a perspective view illustrating roughly the constitution of a plotter having a carriage with a cleaning member fixed thereon of still another example.

FIG. 26 is a perspective view illustrating roughly the constitution of a plotter of still another example having a carriage with a cleaning member fixed thereon. In FIG. 26, the same symbols are used to represent corresponding constitutional elements as in FIG. 24.

The plotter 112 has a Mylar sheet member 102 placed slightly upstream before the image formation zone in the recording medium delivery direction (arrow A direction) to prevent staining by the mist. The sheeting member 102 is narrow and long, extending in the arrow B direction. The recording medium is delivered through under this sheet member 102.

In formation of an image on a recording paper sheet, the printing head 18 ejects ink onto a recording sheet while moving together with the carriage 114 in reciprocation in the arrow B direction. A part of the ink ejected from the printing head 18 is scattered in a mist state before reaching the recording sheet to adhere to a deposition area 102*a* (shadowed area) of the sheeting member 102, whereby the deposition area 102*a* is soiled by the ink.

A cleaning member 116 is fixed to the bottom end of the carriage 114 for cleaning the above deposition area 102*a*. This cleaning member 116 has a roller structure with the cleaning roller 116*a* rollable freely. With reciprocating movement of the carriage 114 in the arrow B direction, the cleaning member 116 wipes the ink on the deposition area 102*a* by rolling of cleaning roller 116*a*. Thereby the sheet member 102 is cleaned to prevent staining of the hand or clothes of the operator. The cleaning roller 116*a* is constituted of a sponge or a like material capable of absorbing the ink. The cleaning 54 may be fixed to the print head 18.

A still another example of the cleaning member is described by reference to FIG. 27.

Figure 27:
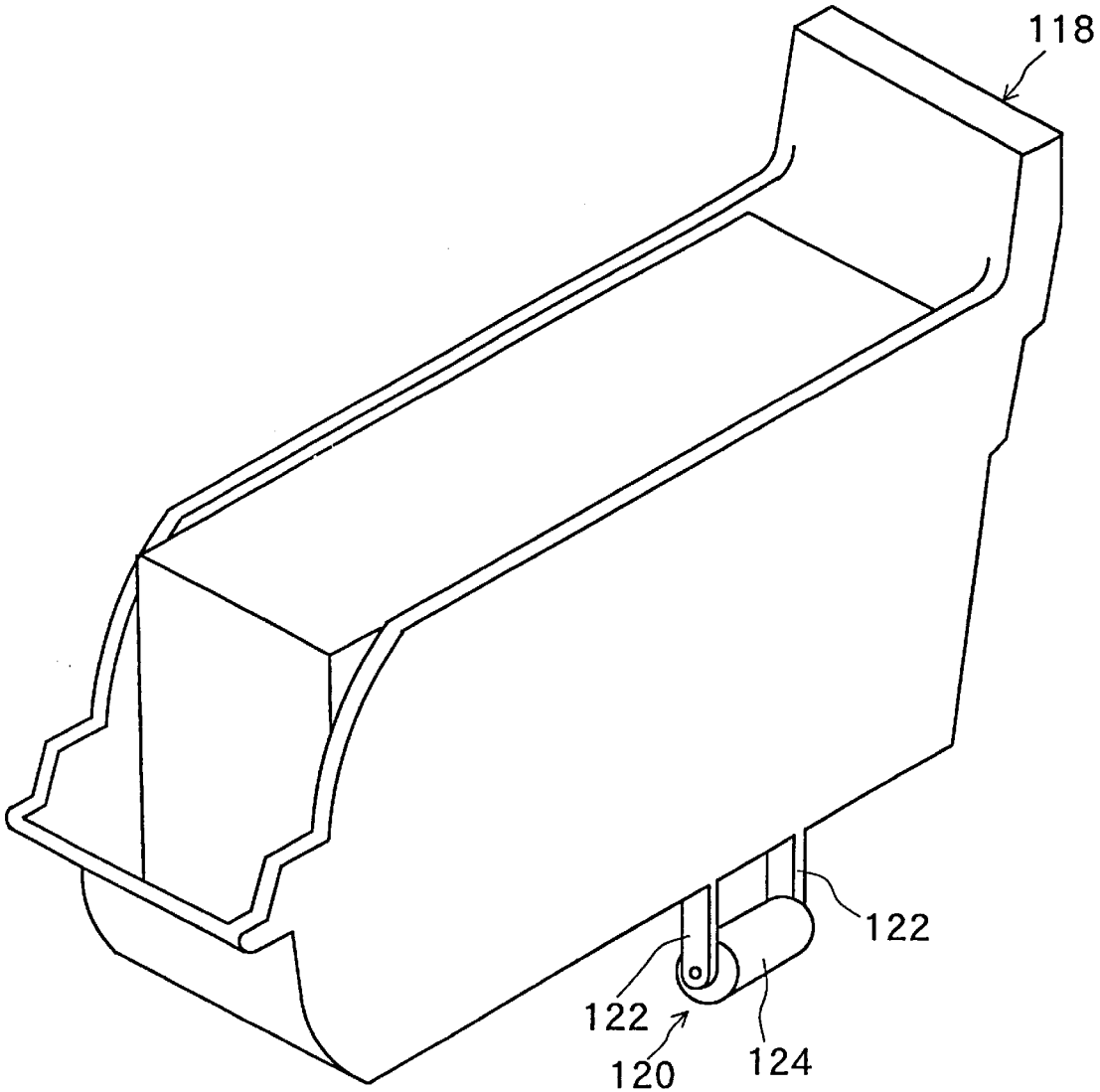
FIG. 27 is a perspective view of a printing head having a cleaning member fixed thereto of still another example.

FIG. 27 is a perspective view of a printing head having a cleaning member fixed thereto.

The cleaning member of this example is characterized in that the cleaning member 120 is fixed to the bottom end of the printing head 118. The cleaning member 120 serves to clean the deposition area 102*a* (see FIG. 24). The cleaning member 120 has a roller construction in which a cleaning roller 124 is held rollably by a pair of arms 122 fixed at the bottom end of the printing head 118. With reciprocation movement of the carriage 16 (see FIG. 33) in the arrow B direction, the cleaning member 120 wipes the ink adhering to the deposition area 102*a* by rolling of the cleaning roller 124. Thereby the sheet member 102 is cleaned to prevent staining of the hand or clothes of the operator. The cleaning member 124 is constituted of a sponge or a like material capable of absorbing the ink.

The printing head 118 is demountable from the carriage 16 (see FIG. 33). Therefore, the cleaning member 120 is exchanged simultaneously with exchange of the printing head 118, which shortens the required service period for one cleaning member 110. Therefore, the sheeting member 102 (see FIG. 24) can be cleaned surely even with a smaller cleaning member 120.

A fourth embodiment of the present invention is described below by reference to FIGS. 28–31.

Figure 28:
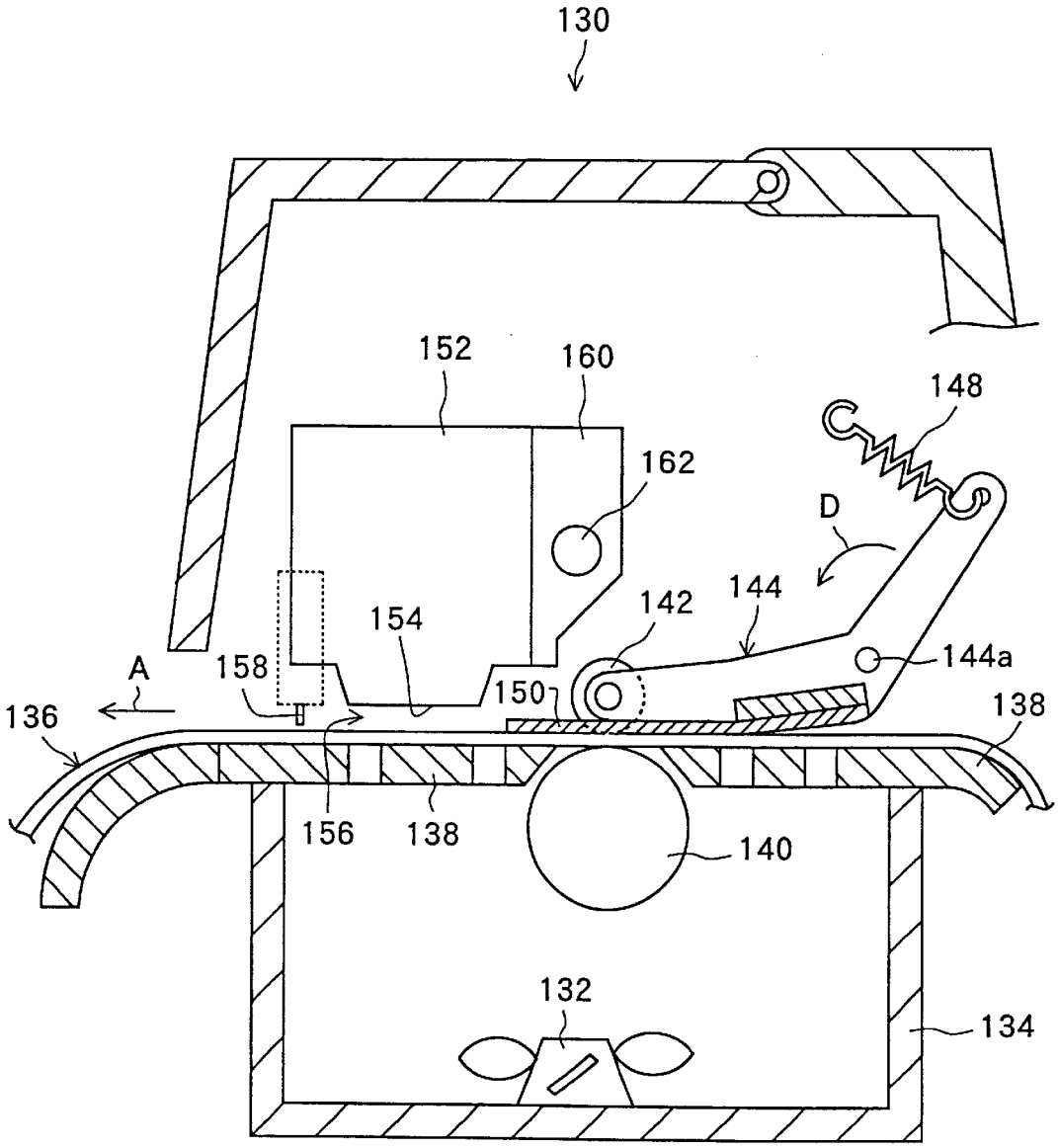
FIG. 28 is a partial sectional view illustrating schematically a plotter of the fourth embodiment.
Figure 29:
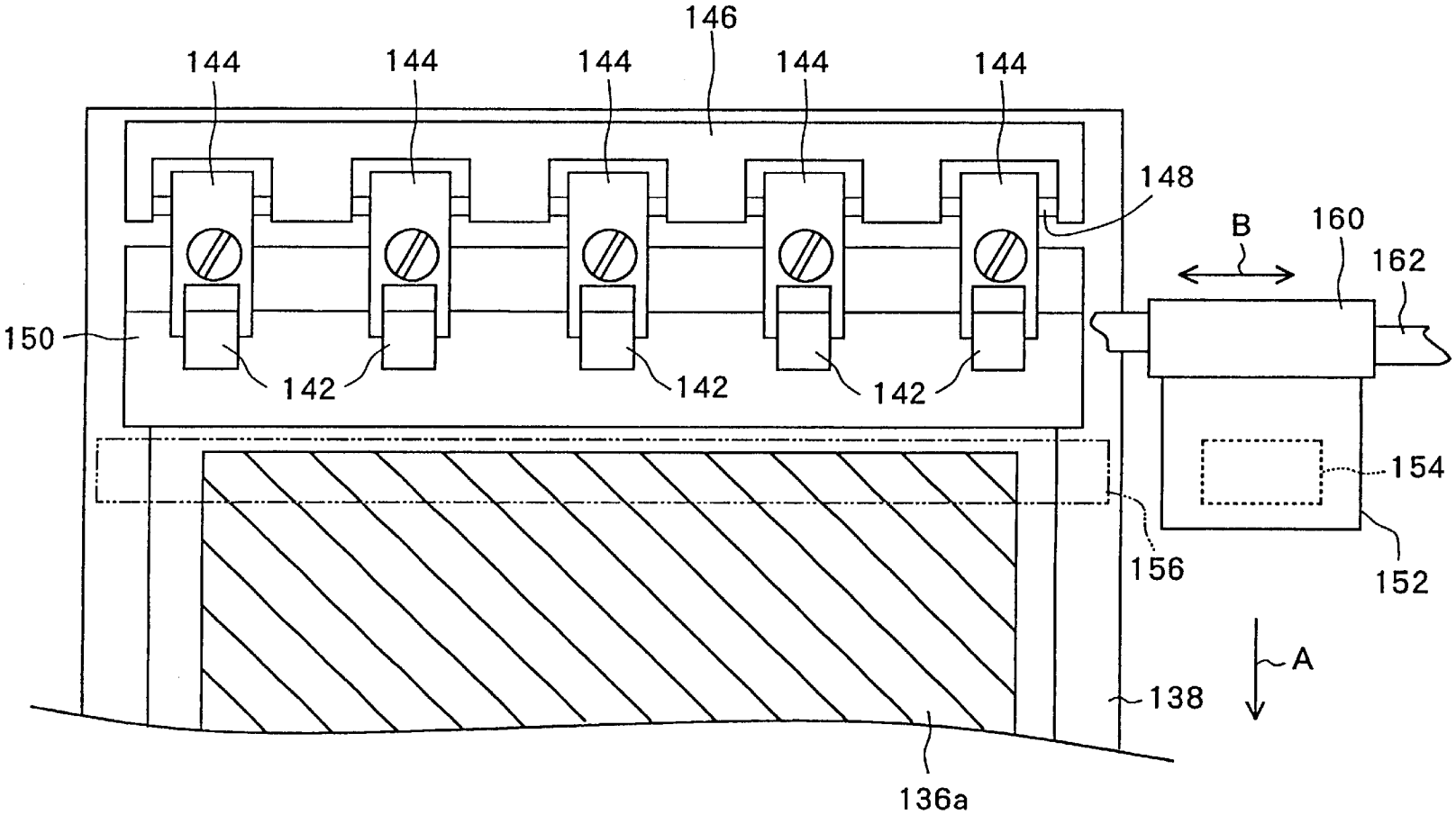
FIG. 29 is a plan view illustrating schematically the main portion of the plotter shown in FIG. 28.
Figure 30:
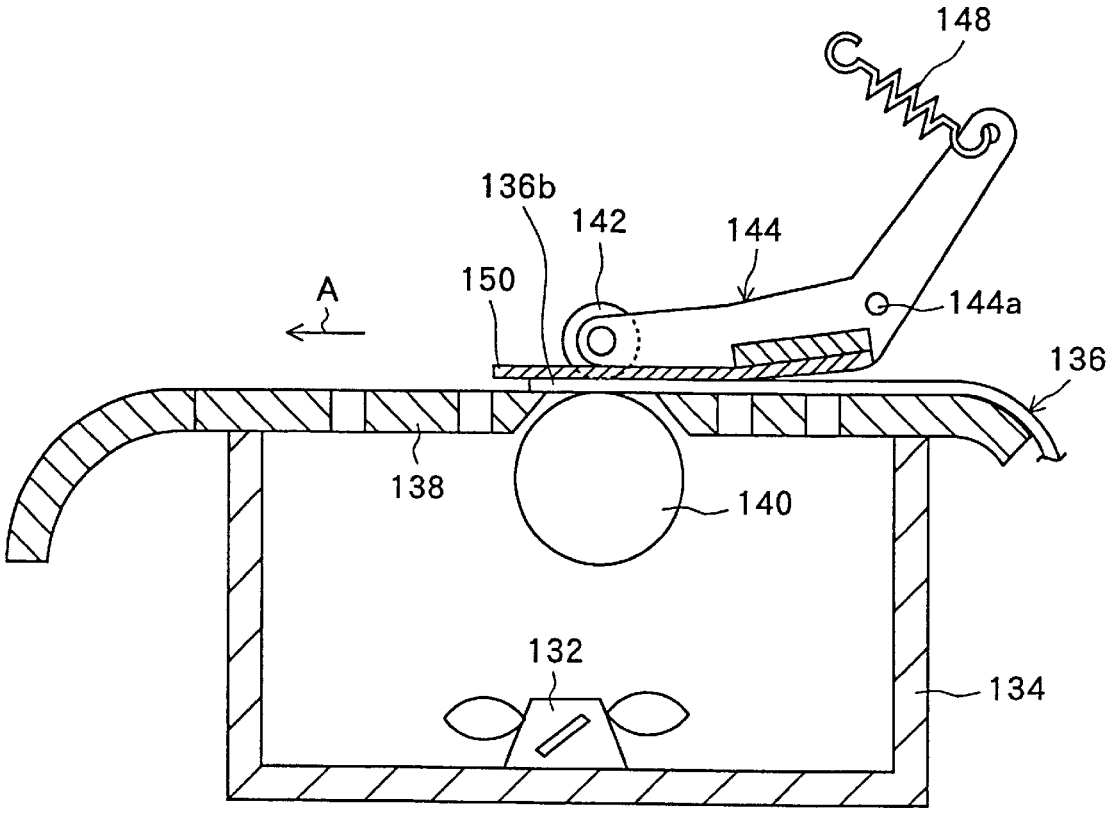
FIG. 30 is a partial lateral sectional view illustrating schematically the plotter with a recording medium in a standby state.
Figure 31:
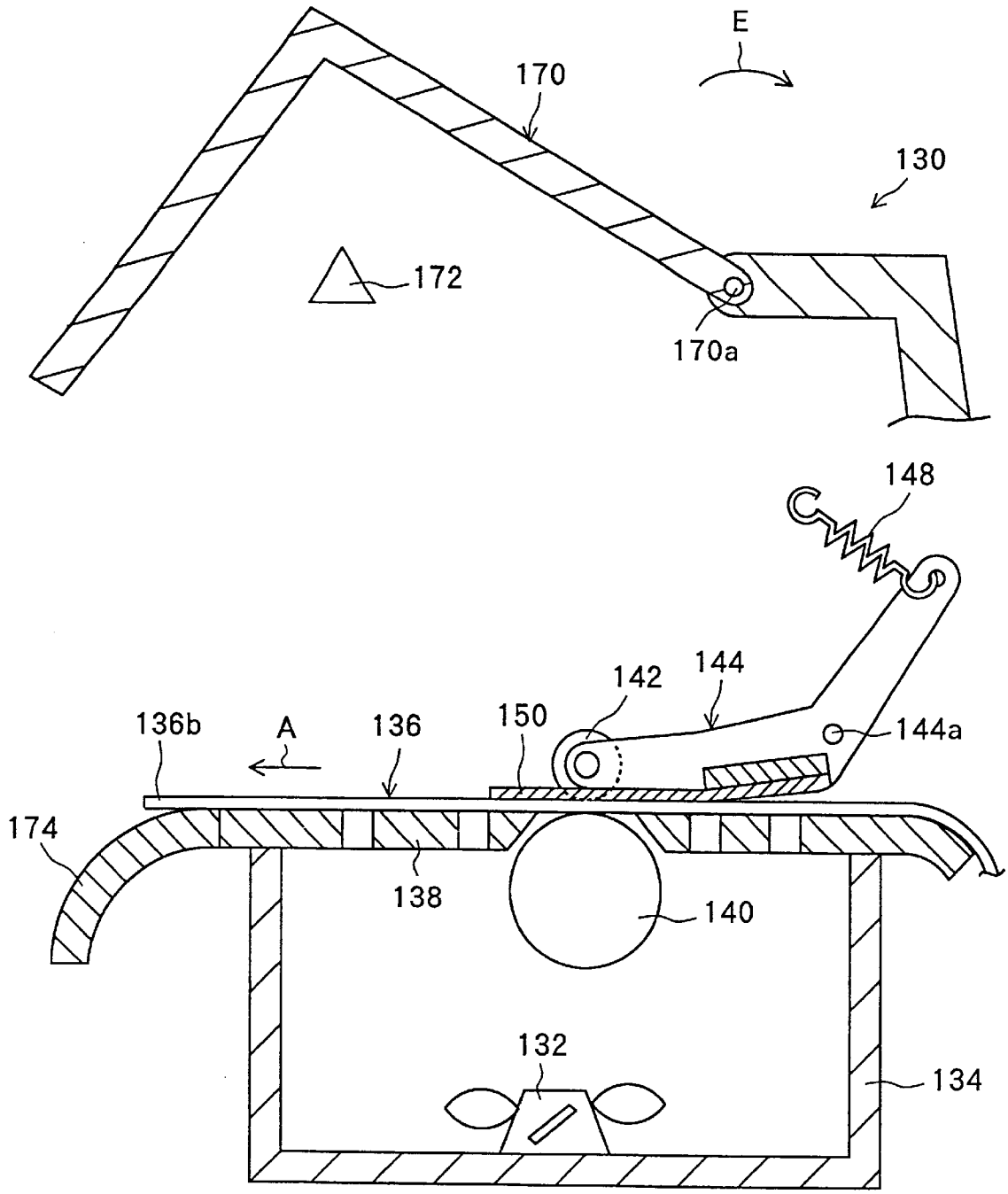
FIG. 31 is a partial lateral sectional view illustrating schematically a plotter in removing (or releasing) a recording medium.

FIG. 28 is a partial sectional view illustrating schematically a plotter of the fourth embodiment. FIG. 29 is a plan view of the main portion of the plotter shown in FIG. 28. FIG. 30 is a partial lateral sectional view illustrating schematically the plotter with a recording medium in a standby state. FIG. 31 is a partial lateral sectional view a plotter in removing (or releasing) a recording medium.

A plotter 130 has a fan 132 and a casing 134 housing the fan 132. A platen 138 for placing a recording medium 136 serves as the upper cover of the casing 134. The recording medium 136 placed on the platen 138 is delivered in the arrow A direction (delivery direction).

A delivery roller 140 is provided inside (or under) the platen 138 for delivering the recording medium 136. Plural driven rollers 142 are pressed against (press-contacted with) the delivery roller 140 from the above. The driven rollers 142 are placed at prescribed intervals in the main scanning direction (arrow B direction). The driven rollers 142 are respectively fixed rollably at the tip of roller holders 144. The driven rollers are allowed to roll by the rotation of the driving roller 140, whereby the recording medium 136 held between the delivery roller 140 and the driven rollers 142 is delivered in the arrow A direction.

A carriage 160 is placed above the platen 138. The carriage 160 carries a printing head 152, and moves in reciprocation (in the arrow B direction). This carriage 160 is guided by a guide rail 162 extending in the arrow B direction, and conducts scanning. An ink ejection face 154 is provided on the bottom face of the printing head 152 for ejection of the ink.

The roller holders 144 are respectively fixed through an axis 148 to supporters 146 attached to the casing 134. The back ends (upper ends) of the-roller holders 144 are connected respectively to the ends of coil springs 148 as shown in FIG. 28. The coil springs 148 are connected at the other ends to the casing 134. Thereby, the roller holders 144 are energized by the coil spring 148 to turn in the arrow D direction around the turning axis 144*a* to press the driven rollers against the delivery roller 140. The driven roller 142 is detached from the delivery roller 140 by turning the roller holder 144 in the direction opposite to the arrow D around the turning axis 144*a*.

At the bottom faces of the roller holders 144, a pressing sheet 150 (an example of the pressing means in the present invention) is fixed to press down the recording medium 136 against the platen 138. The parts (adhesion parts) of the pressing sheet near the turning axis 144*a* of the roller holders 144 is fixed firmly to the bottom face of the roller holder 144 with an adhesive or the like. The pressing sheet 150 extends from the adhesion parts in the arrow A direction.

The pressing sheet 150 is placed upstream before the ink ejection face 154 of the printing head 152 in the arrow A direction. This ink ejection face 154 fronts an image formation zone 156 (scanning zone of the printing head 152). That is, the image formation zone 156 is provided downstream after the delivery roller 140 in the arrow A direction (downstream in the delivery direction). Therefore, the pressing sheet 150 has a length corresponding to the distance from the position of the driven roller 142 to the upstream side before the image formation zone in the arrow A direction as shown in FIG. 29, and has a breadth larger a little than that of the recording medium 136 in the arrow B direction within the platen 138. Here the breadth of the recording medium 136 signifies the length in the arrow B direction.

The pressing sheet 150 is cut out at the portions facing to the driven rollers 142 to bring the driven rollers 142 into direct contact with the recording medium 136. The pressing sheet 150 is nearly rectangular and is made from a thin flexible sheet.

In a press-contact state of the driven roller 142 with the delivery roller 140, the pressing sheet 150 presses the recording medium 156 against platen 138 at the portion ranging from the upstream side of the delivery roller 140 in the arrow A direction to the image formation zone 156 over the entire breadth of the recording medium. In this state, the pressing sheet 150 is bent and is brought into close contact with the recording medium 136.

The roller holders 144 are connected to an operating lever (not shown in the drawing) for attaching or detaching the driven rollers 142 to or from the delivery roller 140. By handling the operating lever, the driven rollers 142 can be pressed against the delivery roller 140, or can be detached from the delivery roller 140. Simultaneously with attaching or detaching movement of the driven rollers 142, the pressing sheet 150 is attached to or detached from the recording medium 136 on the platen 138. Therefore, the pressing sheet 150 does or does not presses the recording medium 136 against the plotter 138 in accordance with the state of the driven rollers 142 and the delivery roller 140 to deliver or not to deliver the recording sheet 136.

The pressing force (energizing force of the coil spring 148) of the pressing sheet against the recording medium 136 is set to deliver the recording medium 136 smoothly on the face of the platen 138 without adverse effect on the delivery.

In formation of an image with the aforementioned plotter 130 on a recording medium 136, a larger amount of ink may be ejected from the ink ejection face 154 of the printing head 152 onto the recording medium 136. In this case, the image portion 136*a* (portion on which the image has been formed) may be waved by the difference of expansion by absorption of a large amount of ink between in the fibrous portion and in the nonfibrous portion of the recording medium 136 as shown in FIG. 29. However, the recording medium 136 can be kept flat by pressing with the pressing sheet 150 against the platen 138 not to rise at or near the ink ejection face 154. Thereby, image can be formed satisfactorily without causing contact of the recording medium 136 with the ink ejection face 154.

The recording medium 136 is pressed in the area from the upstream side to the downstream side of the driven roller 142 in the arrow A direction by the pressing sheet 150 against the platen 138. Therefore, the recording medium 136 is delivered by the contact-pressing by driven rollers 142 and other forces without loosening. The recording medium 136 is sucked onto the platen 138 by rotation of a fan 132 over the entire breadth thereof for stable delivery.

As described above, the recording medium 136 after image formation thereon will not come into contact with the ink ejection face 154 of the printing head 152 not to be rubbed by it. Thus, deterioration of the image quality caused by the rubbing, or damage of the recording medium 136 by hooking by the ink ejection face 154 is prevented.

The pressing sheet 150 is preferably made of a material of a smaller frictional coefficient, and is not specially limited. The pressing sheet 150 made from a material of a smaller frictional coefficient does not cause hooking or abrasion of the recording medium 136 at the surface advantageously.

After the image formation, the recording medium 136 is cut by a cutter 158 shown in FIG. 28. After the cutting, the plotter comes to the standby state. In the standby state, the delivery roller 140 is rotated in a reverse direction to draw back the recording medium 136 by a prescribed length in the direction reverse to the arrow A.

In the state in which the recording medium 136 has been drawn back by reverse rotation of the delivery roller 140 and stopped as shown in FIG. 30, the downstream end 136*b* of the recording medium 136 is placed upstream before the downstream end of the pressing sheet 150 in the arrow A direction, and downstream after the driven roller 142 of the driving roller 142 in the arrow A direction. Thereby, the downstream end 136*b* of the recording medium 136 is covered with the pressing sheet 150.

With the downstream end portion 136*b* covered with the pressing sheet 150, the covered portion is affected less by the humidity even in a high humidity environment, and will not rise up by absorption of moisture since the portion is pressed down by the pressing sheet 150 against the platen 138. This prevents rubbing of the ink ejection face 154 by the rising portion of the recording medium 136 .

However, in the state in which the downstream end 136*b* in the recording medium delivery direction is covered by the pressing sheet 150 as shown in FIG. 30, detachment of the driven roller 142 from the delivery roller 140 may cause fall of the recording medium 136 backward (upstream in the arrow A direction). The measure of prevention of this backward fall of the recording medium is explained by reference to FIG. 31.

In the plotter 130, the protection cover 170 (an example of the protecting member in the present invention) covering the pressing sheet 150 and the image formation zone 156 is provided above the platen 138. This protecting cover 170 is openable around the axis 170*a* extending in the arrow B direction (perpendicular to the paper sheet face of FIG. 31).

Above the platen 138, a photosensor 172 (an example of the opening-closing detecting means in the present invention) is placed to detect the opening or closing state of the protecting cover 170. The photosensor 172 puts out the opening-closing signal of 0 volt when the protecting cover 170 is opened, and puts out the opening-closing signal of 5 volts when the protecting cover 170 is closed.

A controller (not shown in the drawing) controls the delivery roller 140 according to the opening-closing signals put out by the photosensor 172, thereby the delivery roller 140 rotates as prescribed to conduct prescribed delivery of the recording medium.

An example of the operation of the prescribed delivery of the recording medium is explained below.

In the formation of an image on the recording medium 136, the recording medium 136 is held (or set) between the delivery roller 140 and the driven roller 142, and an ink is ejected from the ink ejection face 154 (see FIG. 28) to form the image with the delivery of the recording medium 136 in the arrow A direction.

When the user wishes to change size of the recording medium 136 by recognizing setting of a wrong sized recording medium 136 or other reasons after setting of the recording medium 136, the protecting cover 170 is opened by the user. When the protecting cover 170 is opened, the detector detects the open state and puts out the opening-closing signal of 0 volt.

In this example, in accordance with the opening-closing signal of 0 volt of the photosensor 172, the paper sheet discharge tray 140 rotates in the normal direction to deliver the recording medium 136 in the arrow A direction by a prescribed distance. This prescribed distance is equal to the distance at which the down stream end 136*b* of the recording medium 136 in the delivery direction reaches the sheet discharge guide 174.

The recording medium 136 which has its downstream end 136*b* reaching the sheet discharge guide 174 will not fall backward (upstream of the arrow A direction) even when the driven rollers 142 are detached from the delivery roller 140. This makes easy the removal of the recording medium 136,.

Figure 32:
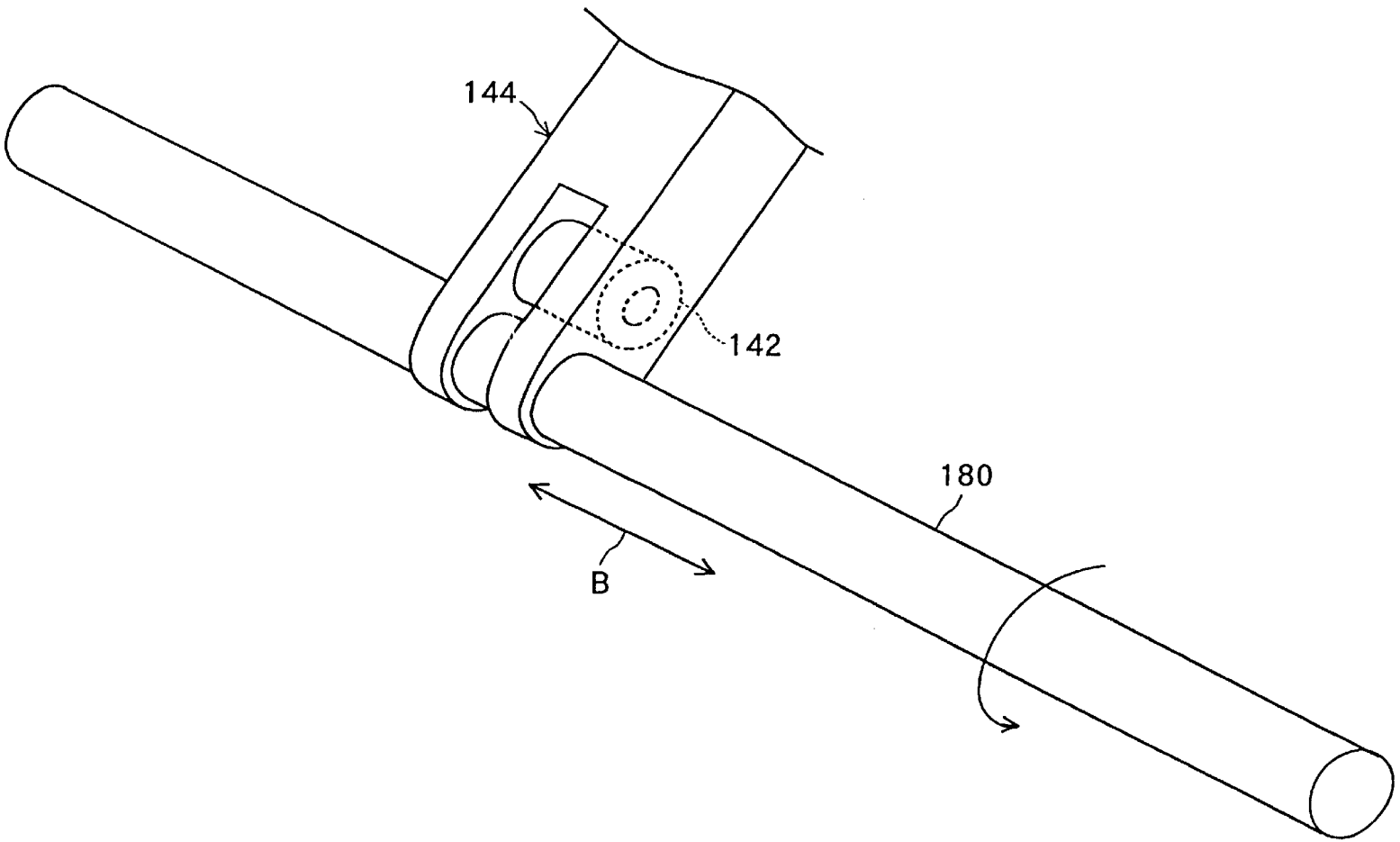
FIG. 32 is a perspective view of the pressing member of another example.

In the above example, a pressing sheet 150 is used for pressing down the recording medium 136 against the platen 138. The pressing sheet 150 may be replaced by a pressing bar 180 as shown in FIG. 32.

The pressing bar 180 is a bar-shaped member extending in the arrow B direction (breadth direction of the recording medium). This pressing bar 180 is fixed rollably to the tip portion of a roller holder 144. The pressing bar 180 is placed near the image formation zone 156 slightly upstream before the image formation region 156 in the delivery direction.

The roller holder 144 has a hole at the tip portion for inserting the pressing bar 180. The hole may be made longer in size for easy attachment (easy insertion) of the roller holder 144. With the larger size of the hole, the pressing bar 180 can press the recording medium 136 with latitude.

INDUSTRIAL APPLICABILITY

As described above, in the ink-jet type of image-forming apparatus of the first embodiment, rise of the recording medium upstream before the image formation zone in the recording medium delivery direction can be suppressed by a rise-suppressing member. This prevents contact of the recording medium with or hooking thereof by the printing head placed above the image formation zone, preventing damage of the recording medium or the printing head.

The rise-suppressing member may comprise an upstream sheet-pressing member provided rollably and nearly coaxially with the driven roller, and a recording sheet-controlling member provided between the upstream sheet-pressing member and the image formation zone, and extending perpendicular to the recording medium delivery direction. The upstream sheet-pressing member and the sheet-controlling member ensure further the rise of the recording medium.

The recording medium delivery unit may comprise a touch-controlling means for controlling attach or detach of the driven roller to or from the driving roller, and the rise-suppressing member may be moved jointly with the touch-controlling means Thereby, when a recording paper sheet Jams, the driven roller is detached from the driving roller together with the rise-suppressing member to facilitate the release of the jamming. Thus the recording medium delivery unit is readily handleable.

The sheet-controlling member may have been treated for water repellence at the portion fronting the image formation zone. This water repellence retards adherence of the ink to the portion of the sheet-controlling means fronting the image formation zone, thereby preventing the staining of the recording medium being delivered.

There is another problem: the ink ejected from the printing head may adhere, in a state of the mist, to the rise-suppressing member; or the recording medium may rise up to come into contact with the rise-suppressing member, causing staining of the recording medium with the ink adhering to the rise-suppressing member. However, in the ink-jet type image-forming apparatus of the second embodiment, the cleaning member in this apparatus cleans the rise-suppressing member to remove the ink threrefrom to prevent staining of the recording medium by the ink even when the recording medium comes into contact with the rise-suppressing member. Thereby, the staining of the recording medium with the ink is prevented. The rise-suppressing member prevents rising of the recording medium not to cause the contact of the recording medium with the printing head. Consequently, no deterioration of the image is caused by disturbance of ink ejection from the printing head, or no damage of the printing head is caused by the recording medium.

The aforementioned ink-jet type image-forming apparatus may comprise a driving roller which is placed upstream before the image formation zone in the sheet delivery direction and delivers the recording medium in the delivery direction; a driven roller which is driven by the driving roller and delivers the recording sheet by catching the recording sheet jointly with the driving roller; and a rise-suppressing member which may have a bar-shaped sheet-controlling member extending in an auxiliary scanning direction nearly perpendicular to the aforementioned scanning direction, placed between the driving roller and the image formation zone, In this case, the recording medium can be delivered more steadily by holding the recording medium between the driving roller and the driven roller. The bar-shaped sheet-controlling member as the rise-suppressing member has a simpler structure.

The sheet-controlling member may be made of an electric insulating material. The insulating sheet-controlling member accumulates electric charge which may be generated by sliding of the sheet-controlling member on the recording medium. The mist is allowed to be preferentially adsorbed electrostatically by the sheet-controlling member by designing the sheet-controlling member to be charged in a polarity opposite to that of the mist of the ink ejected from the printing head.

Thereby, the mist is hardly adsorbed by the members other than the sheet-controlling member. The mist adsorbed thus by the sheet-controlling member can be removed by the cleaning member. Consequently, most of the mist is adsorbed by the sheet-controlling member and is removed by the cleaning member without adhesion of the mist by other members and parts.

Furthermore, the sheet-controlling member, which is chargeable in a polarity opposite to the polarity of the ink ejected from the printing head, adsorbs the mist electrostatically. Thereby, the ink mist can be collected and removed readily without scattering the mist to the outside.

The cleaning member may be made of an electroconductive material and be grounded. This cleaning member will not accumulate the electric charge, thereby preventing malfunction caused by the electric charge accumulated in the cleaning member.

The cleaning member may be fixed to the printing head or the carriage. Then this cleaning member is exchanged together with the printing head or the carriage since they are usually exchangeable. Thereby, the ink mist can be further surely removed from the rise-suppressing member.

The cleaning member may be rollable freely in contact with the rise-suppressing means. This rollable cleaning member further surely the ink mist adsorbed by the rise-suppressing member.

In the ink-jet type image-forming apparatus of the third embodiment of the present invention, the recording medium being delivered may rub the rise-suppressing member. This rubbing generates static electricity between the rise-suppressing member and the recording medium. The electric charge can accumulate in the rise-suppressing member, and be discharged when the charge has accumulated in a certain amount. If the electric charge is discharged, for example, to the metal parts of the printing head, it may cause malfunction of the ink-jet type image-forming apparatus to form an abnormal image. However, the electric charge accumulated in the rise-suppressing member is removed by the static eliminating member to prevent the electric discharge to the metal parts of the printing head or in the periphery thereof and to prevent the malfunction or abnormal image formation. The static eliminating member removes firstly the accumulated electric charge from the rise-suppressing member. Therefore, the electric discharge to the metal parts of the printing head and other peripheral parts can be prevented further surely and the malfunction and abnormal image formation is more surely prevented. The static eliminating member is fixed to the printing head or the carriage, so that the static eliminating member removes the electric charge with the reciprocating movement of the printing head or the carriage, with simple constitution of the static eliminating member.

In the ink-jet type image-forming apparatus of the fourth embodiment of the present invention, the cleaning member cleans the sheeting member with reciprocating movement of the carriage or the printing head to conduct surely the cleaning of the sheeting member at each reciprocating movement of the carriage or the printing head. Therefore the hand or the clothes of the user is not stained.

The printing head may be made demountable from the carriage, and the cleaning member may be fixed to the printing head. In this case, the cleaning member is exchanged together with the printing head. Therefore, the cleaning member is exchanged simultaneously with exchange of the printing head, which shortens the required service period for one cleaning member. Thereby, the sheeting member can be cleaned surely even with a smaller cleaning member.

The cleaning member may have a cleaning roller rollable with the movement of the cleaning member in the main scanning direction. With this rollable cleaning roller, frictional resistance between the cleaning member and the sheeting member is smaller, which decreases adverse effects of vibration or other influence caused by the movement of the cleaning member.

The rolling of the cleaning roller increases the contact area to improve the cleaning efficiency of the cleaning member.

In the fifth embodiment of the ink-jet type image-forming apparatus of the present invention, a pressing means presses down the recording medium against the platen. Therefore, the recording medium will not come into contact with or will not rub the printing head, which prevents rupture of the recording medium or the damage of the image. Therefore, the ink-jet type image-forming apparatus has higher reliability.

In this embodiment, the image formation zone is provided downstream after the delivery means in the delivery direction, and the pressing means may press down, against the platen, the recording medium at the portion ranging from the upstream side before the delivery means to the image formation zone throughout the entire breadth perpendicular to the delivery direction. Thereby, the pressing means prevents rise of the recording medium more surely.

The pressing means may be incorporated into the delivery means, and may press or not press the recording medium against the plotter according to the state of delivery or non-delivery. Thereby, the handling of the recording medium is facilitated to render the ink-jet type image-forming apparatus easily handleable.

The pressing means may be made of a flexible sheet material, thereby, the construction of the pressing means being made simpler.

The pressing means may be a bar-shaped member placed between the image formation zone and the recording medium delivery means thereby the construction of the pressing means being made simpler.

The delivery means may pull back the recording medium so as to be sheeted by the pressing means at the downstream end of the recording medium in the delivery direction in a standby state before starting the image formation. Thereby the rise of the recording medium is more surely prevented even when the recording medium is left set under a high humidity conditions since the recording medium is protected from moisture.

The delivery means may move the recording medium by a prescribed length forward in the delivery direction to bring the downstream end of the recording medium to be on a downstream side of the pressing means in the delivery direction, in removal of the recording medium. Thereby, the recording medium can be removed and reset readily and surely without falling out of the recording medium from the apparatus.

The ink-jet type image-forming apparatus may be provided with a openable protecting member for covering the image formation zone and the pressing means; and an opening-closing detection means to make opening-closing detection signal by detecting the opening-closing state of the protecting member, and the delivery means may deliver the recording medium in accordance with the opening-closing signals from the aforementioned opening-closing means. In this case, the recording medium can be more readily removed.

What is claimed is:

1. A recording medium delivery unit for an image-forming apparatus for forming an image on a recording medium delivered in a prescribed delivery direction in an image formation zone, the recording medium delivery unit comprising:

a driving roller provided upstream before the image formation zone in the recording medium delivery direction for delivering the recording medium in the recording medium delivery direction, a driven roller for holding and delivering the recording medium jointly with the driving roller, and a rise-suppressing member provided upstream before the image formation zone in the recording medium delivery direction for preventing the recording medium from rising; and the rise-suppressing member comprising an upstream sheet-pressing member provided rollably and nearly coaxially with the driven roller, and a sheet-controlling member provided rollably between the upstream sheet-pressing member and the image formation zone, and extending perpendicular to the recording medium delivery direction.

2. The recording medium delivery unit according to claim 1, wherein a touch-controlling means is provided for controlling attach or detach of the driven roller to or from the driving roller, and the rise-suppressing member moves jointly with the touch-controlling means.

3. The recording medium delivery unit according to claim 2, wherein the sheet-controlling member has been treated for water repellence at the portion fronting the image formation zone.

4. The recording medium delivery unit according to claim 1, wherein the sheet-controlling member has been treated for water repellence at the portion fronting the image formation zone.

5. An ink-jet type image-forming apparatus provided with a carriage carrying a printing head for ejecting ink, and movable in reciprocation in the prescribed main scanning direction for forming an image on a recording medium being delivered in a prescribed delivery direction in an image formation zone by ejecting an ink from the printing head, the ink-jet type image-forming apparatus comprising:

a rise-suppressing member provided upstream before the image formation zone in the recording medium delivery direction for suppressing rise of the recording medium, a cleaning member for cleaning the rise-suppressing member, a driving roller which is placed upstream before the image formation zone in the sheet delivery direction and delivers the recording medium in the delivery direction, and a driven roller which is driven by the driving roller and delivers the recording sheet by catching the recording sheet jointly with the driving roller; and the rise-suppressing member having a bar-shaped sheet-controlling member placed between the driving roller and the image formation zone and extending in an auxiliary scanning direction nearly perpendicular to the aforementioned scanning direction.

6. The ink-jet type image-forming apparatus according to claim 5, wherein the sheet-controlling member is made of an electric insulating material.

7. The ink-jet type image-forming apparatus according to claim 6, wherein the sheet-controlling means is electrically chargeable in a polarity opposite to the polarity of the ink ejected from the printing head.

8. The ink-jet type image-forming apparatus according to claim 6, wherein the cleaning member is made of an electroconductive material and is grounded.

9. The ink-jet type image-forming apparatus according to claim 6, wherein the cleaning member is fixed to the printing head or the carriage.

10. The ink-jet type image-forming apparatus according to claim 6, wherein the cleaning member is rollable freely in contact with the rise-suppressing member.

11. The ink-jet type image-forming apparatus according to claim 5, wherein the sheet-controlling means is electrically chargeable in a polarity opposite to the polarity of the ink ejected from the printing head.

12. The ink-jet type image-forming apparatus according to claim 11, wherein the cleaning member is made of an electroconductive material and is grounded.

13. The ink-jet type image-forming apparatus according to claim 11, wherein the cleaning member is fixed to the printing head or the carriage.

14. The ink-jet type image-forming apparatus according to claim 11, wherein the cleaning member is rollable freely in contact with the rise-suppressing member.

15. The ink-jet type image-form apparatus according to claim 5, wherein the cleaning member is made of an electroconductive material and is grounded.

16. The ink-jet type image-forming apparatus according to claim 15, wherein the cleaning member is fixed to the printing head or the carriage.

17. The ink-jet type image-forming apparatus according to claim 15, wherein the cleaning member is rollable freely in contact with the rise-suppressing member.

18. The ink-jet type image-forming apparatus according to claim 5, wherein the cleaning member is fixed to the printing head or the carriage.

19. The ink-jet type image-forming apparatus according to claim 18, wherein the cleaning member is rollable freely in contact with the rise-suppressing member.

20. The ink-jet type image-forming apparatus according to claim 5, wherein the cleaning member is rollable freely in contact with the rise-suppressing member.

21. An ink-jet type image-forming apparatus, provided with a carriage carrying a printing head for ejecting ink and movable in reciprocation in the prescribed main scanning direction for forming an image on a recording medium delivered in a prescribed delivery direction in an image formation zone by ejecting an ink from the printing head, the ink-jet type image-forming apparatus comprising a rise-suppressing member for suppressing a rise of the recording medium at or around the image formation zone, and a static eliminating member fixed to the printing head or the carriage to discharge firstly the electric charge accumulated in the rise-suppressing member without contact with the rise-suppressing member.

22. A cleaning member provided, in the ink-jet recording apparatus for forming an image by ejecting an ink from a printing head mounted on a carriage reciprocating in a prescribed scanning direction to form an image on a portion of a recording medium delivered in a prescribed delivery direction and placed in the image formation zone in front of the printing head, for cleaning a sheeting.member sheeting the area on and around the upstream side beyond the image formation zone in the recording sheet delivery direction, wherein the printing head is demountable from the carriage, and is exchangeable when the contained ink has been used up, and the cleaning member is fixed to the printing head, and has a cleaning roller rollable with the reciprocating movement of the cleaning member in the main scanning direction to clean the cheeting member.

23. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the pressing means is made of a flexible sheet material, and wherein the pressing means is bent and is brought into close contact with the recording medium when the pressing means presses the recording medium.

24. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the delivery means pulls back the recording medium so as to be sheeted by the pressing means at the downstream end of the recording medium in the delivery direction in a standby state before starting the image formation.

25. The ink-jet type image-forming apparatus according to claim 24, wherein, in removal of the recording medium at a standby position, the delivery means moves the recording-medium by a prescribed distance forward in the delivery direction to bring the downstream end thereof to be on a downstream side of the pressing means in the delivery direction.

26. The ink-jet type image-forming apparatus according to claim 24, wherein the ink-jet type image forming means comprises an openable protecting member for covering the image formation zone and the pressing means, and an opening-closing detection means to emit opening-closing detection signals; and the delivery means delivers the recording medium in accordance with the opening-closing signals from the aforementioned opening-closing detection means.

27. An Ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein, in removal of the recording medium at a standby position, the delivery means moves the recording medium by a prescribed distance forward in the delivery direction to bring the downstream end thereof to be on a downstream side of the pressing means in the delivery direction.

28. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses dozen, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the ink-jet type image forming means comprises an openable protecting member for covering the image formation zone and the pressing means, and an opening-closing detection means to emit opening-closing detection signals; and the delivery means delivers the recording medium in accordance with the opening-closing signals from the aforementioned opening-closing detection means.

29. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the pressing means is made of a flexible sheet material, and wherein the delivery means pulls back the recording medium so as to be sheeted by the pressing means at the downstream end of the recording medium in the delivery direction in a standby state before starting the image formation.

30. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the pressing means comprises a bar-shaped member placed between the image formation zone and the recording medium delivery means, and wherein the delivery means pulls back the recording medium so as to be sheeted by the pressing means at the downstream end of the recording medium in the delivery direction in a standby state before starting the image formation.

31. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the pressing means is made of a flexible sheet material, and wherein, in removal of the recording medium at a standby position, the delivery means moves the recording medium by a prescribed distance forward in the delivery direction to bring the downstream end thereof to be on a downstream side of the pressing means in the delivery direction.

32. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the pressing means comprises a bar-shaped member placed between the image formation zone and the recording medium delivery means, and wherein, in removal of the recording medium at a standby position, the delivery means moves the recording medium by a prescribed distance forward in the delivery direction to bring the downstream end thereof to be on a downstream side of the pressing means in the delivery direction.

33. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the pressing means is made of a flexible sheet material, wherein the ink-jet type image forming means comprises an openable protecting member for covering the image formation zone and the pressing means, and an opening-closing detection means to emit opening-closing detection signals; and the delivery means delivers the recording medium in accordance with the opening-closing signals from the aforementioned opening-closing detection means.

34. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, wherein the image formation zone is provided downstream after the delivery means in the delivery direction, the delivery means is constituted of a delivery roller and a driven roller in pressure-contact with the delivery roller for delivering the recording medium, the image forming apparatus comprises a pressing means provided near the image formation zone to press the delivered recording medium against the platen, the pressing means presses down, against the platen, the recording medium at the portion ranging from the upstream side before the delivery means to the image formation zone throughout the entire breadth perpendicular to the delivery direction, the pressing means is incorporated into the roller holder supporting the driven roller, and presses or does not press the recording medium against the plotter depending on the state of delivery or non-delivery of the recording medium, wherein the pressing means comprises a bar-shaped member placed between the image formation zone and the recording medium delivery means, wherein the ink-jet type image forming means comprises an openable protecting member for covering the image formation zone and the pressing means, and an opening-closing detection means to emit opening-closing detection signals; and the delivery means delivers the recording medium in accordance with the opening-closing signals from the aforementioned opening-closing detection means.

35. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, the image forming apparatus comprising a pressing means provided near the image formation zone to press the delivered recording medium against the platen, and the delivery means pulling back the recording medium so as to be sheeted by the pressing means at the downstream end of the recording medium in the delivery direction in a standby state before starting the image formation.

36. An ink-jet type image-forming apparatus provided with a delivery means for delivering a recording medium in a prescribed direction, and a platen for holding the recording medium being delivered by the delivery means, and forming an image by ejecting an ink onto the recording medium being delivered by the delivery means in the delivery direction onto the platen, in an image formation zone, the image forming apparatus comprising a pressing means provided near the image formation zone to press the delivered recording medium against the platen, the delivery means delivers, in removal of the recording medium at a standby position, the recording medium by a prescribed distance forward in the delivery direction to bring the downstream end thereof to be on a downstream side of the pressing means in the delivery direction.

37. An ink-jet type image-forming apparatus provided with a delivery means for delivering a recording medium in a prescribed delivery direction, and a platen for holding the recording medium being delivered by the delivery means, and forming an image by ejecting an ink onto the recording medium being delivered by the delivery means in the delivery direction onto the platen, in an image formation zone, the image forming apparatus comprising a pressing means provided near the image formation zone to press the delivered recording medium against the platen, an openable protecting member for covering the image formation zone and the pressing means, and an opening-closing detection means to emit opening-closing detection signals by detecting the opening-closing state of the protecting member; and the delivery means delivering the recording medium in accordance with the opening-closing signals from the aforementioned opening-closing detection means.

* * * * *